US005148148A

United States Patent [19]

Shima et al.

[11] Patent Number: 5,148,148

[45] Date of Patent: Sep. 15, 1992

[54] RADIO ALARM SYSTEM

[75] Inventors: Hiroshi Shima, Machida; Hajime Shimizu, Yamato, both of Japan

[73] Assignee: Hochiki Kabushiki Kaisha, Tokyo, Japan

[21] Appl. No.: 631,352

[22] Filed: Dec. 20, 1990

[30] Foreign Application Priority Data

| | | | |
|---|---|---|---|
| Dec. 28, 1989 | [JP] | Japan | 1-340705 |
| Dec. 28, 1989 | [JP] | Japan | 1-340706 |
| Dec. 28, 1989 | [JP] | Japan | 1-340708 |
| Feb. 28, 1990 | [JP] | Japan | 2-48425 |

[51] Int. Cl.[5] ..... G08B 1/08

[52] U.S. Cl. ..... 340/539; 340/531; 455/34.1

[58] Field of Search ..... 340/539, 531; 455/34

[56] References Cited

U.S. PATENT DOCUMENTS

| | | | |
|---|---|---|---|
| 4,477,799 | 10/1984 | Rocci et al. | 340/531 |
| 4,499,455 | 2/1985 | Leveille et al. | 340/531 |
| 4,628,537 | 12/1986 | Shimakata et al. | 455/34 |
| 4,792,984 | 12/1988 | Matsuo | 455/34 |
| 4,903,322 | 2/1990 | Inahara et al. | 455/34 |

FOREIGN PATENT DOCUMENTS 2-121093 2/1990 Japan .

*Primary Examiner*—Donnie L. Crosland
*Attorney, Agent, or Firm*—Max Fogiel

[57] ABSTRACT

A radio alarm system for detecting abnormalities such as a fire having a central unit which is adapted to receive and decode the radio signal transmitted from each terminal device and to give an alarm and a plurality of terminal devices which is connected to a detector for detecting an abnormal state and is adapted to transmit information in the form of a radio signal based on an abnormality detection signal from the respective associated detector. And delay times which vary from terminal device to terminal device are set, and the selection of a free channel for transmission is effected in each terminal device by performing carrier sensing over a delay time peculiar to that terminal device. Each of the terminal devices is equipped with a channel setting means which successively performs, when transmitting information, carrier sensing on a plurality of transmission channels previously allocated the terminal device, in a previously determined order, thereby selecting a free channel which is not being used by an other terminal device.

7 Claims, 19 Drawing Sheets

| ADDRESS | CHANNEL INFORMATION |
|---|---|
| $A_1$ | CH1 |
| $A_2$ | CH2 |
| $A_3$ | CH3 |
| $A_4$ | CH4 |
| $A_5$ | CH5 |
| $A_6$ | CH6 |
| $A_7$ | CH7 |
| $A_8$ | CH8 |

RADIO ALARM SYSTEM

BACKGROUND OF THE INVENTION

1. Field of the Invention

This invention relates to a radio alarm system for detecting abnormalities such as a fire, and in particular, to a radio alarm system having a central unit and a plurality of terminal devices. Each of the terminal devices is connected to a detector for detecting an abnormal state and is adapted to transmit information in the form of a radio signal based on an abnormality detection signal from the respective associated detector. The central unit is adapted to receive and decode the radio signal transmitted from each terminal device and to give an alarm.

2. Description of the Related Art

Conventionally, a fire alarm system for a building site, etc., has usually consisted of fire detectors arranged at different locations in a building or the like, these fire detectors being connected through wiring to a fire alarm. Apart from this, a radio alarm system has been proposed, according to which terminal devices directly connected to respective fire detectors are arranged on the respective ceilings of those areas requiring supervision. When a fire detection signal is supplied to any one of the terminal devices from the respective associated detector, that terminal device transmits an abnormality detection signal, along with the terminal device address, by radio to a central unit, thereby reporting the abnormal state. In such a radio alarm system, each terminal device is equipped with a battery as the power source, and can be installed at any location where it is required.

In such a radio alarm system, transmission is effected by allocating a number of transmission channels to each of a plurality of terminal devices. The maximum number of terminal devices that allows communication between them and the central unit may, for example, be eight, and the number of channels allocated to each terminal device corresponds to this maximum number of terminal devices that can be provided. If any abnormality is detected by the detector of any one of the terminal devices, that terminal device is first set in a transmitting state, and carrier sensing is performed on one of the channels allocated thereto in order to make a judgment as to whether it is a free channel or not. If it is found that the channel (the first channel in this case) is not being used, it is selected as a free channel. Then, the terminal device is switched over to a transmitting state, and transmits an abnormality detection signal, along with the terminal device address, to the central unit using the channel which has been thus selected through the carrier sensing operation. The transmission of the abnormality detection signal from this terminal device is effected in a continuous manner in which a cycle of a transmission and a rest period are repeated, the respective durations of which may, for example, be eight and two seconds. If the abnormality detection state still prevails at the end of a rest period, carrier sensing is performed again starting from the first channel, i.e., in the order: CH1 (channel 1), . . . , CH8 for the purpose of finding a free channel. After a free channel has been selected through this carrier sensing, the transmitting operation is performed again.

If, in the first carrier sensing, it is found that the first channel is being used by some other terminal device, the object of carrier sensing is instead performed on a second channel. By thus successively performing carrier sensing, carrier sensing is repeated until a free channel is found.

The same number of frequency channels (eight in this case) as are allocated to each terminal device are allocated to the central unit, which is constantly performing carrier sensing successively on the eight channels. When it detects a carrier in any one of the eight channels, the central unit fixes that channel in a receiving state to receive therethrough an abnormality detection signal from one of the terminal devices. It then discriminates and displays the abnormal state, thus giving an alarm.

The generation of an oscillation at the local oscillation frequency to be used in the receiving operation in the carrier sensing effected by each terminal device and the generation of an oscillation at the carrier frequency to be used when performing transmission through a free channel are effected through the setting of dividing ratio data in a PLL circuit.

The PLL circuit is composed of a divider and a phase comparator, and is adapted to compare the division output of a reference oscillator with the division output of a VCO (voltage control oscillator) by means of the phase comparator, performing feedback control of the oscillation frequency of the VCO in such a manner that the output of the phase comparator is reduced to zero. By externally changing the dividing ratio of the divider on the VCO side, a desired oscillation frequency can be obtained from the VCO.

Assuming that the carrier frequency ft1 of channel CH1 is, for example, 429.175 MHz, the local oscillation frequency fr1 for carrier sensing at that time is 407.475 MHz. (It is assumed that the intermediate frequency fi is 21.7 MHz). By setting dividing ratio data in the PLL circuit in such a manner that this local oscillation frequency fr1 is obtained, the carrier sensing on channel CH1 can be effected. If channel CH1 is a free channel, the transmission of an abnormality detection signal can be effected through this channel CH1 by setting, in the PLL circuit, the dividing ratio data on the carrier frequency ft1 of channel CH1.

A problem in such a conventional radio alarm system, however, is that, if two or more terminal devices detect an abnormality simultaneously, the same channel may be selected as a free channel through carrier sensing, that channel being used for the transmission of the respective abnormality detection signals. Such a simultaneous transmission will result in a confusion, and the central unit will regard the data transmitted as ineffective, which means the reception of the abnormality detection signals will become impossible.

Furthermore, in such a conventional radio alarm system, carrier sensing to search for a free channel is also performed starting from the first channel, i.e, in the order: CH1, . . . , CH8, for the re-transmission to be effected after abnormality detection information has once been transmitted from any one of the terminal devices to the central unit. Assuming, for example, that channel CH3 was used in the previous transmission since channels CH1 and CH2 had been found to be in use in the previous carrier sensing, it is quite possible that channels CH1 and CH2 are also found to be in use this time, which means it takes a relatively long time to find a free channel through carrier sensing if a carrier sensing is performed starting from the first channel CH1 in order. This is particularly true of the case where a plurality of terminal devices are operated all at once on the occasion of a test or the like, all the terminal devices transmitting an abnormality detection signal all at once. Since carrier sensing is then started from the first channel in every terminal device, signals collide with each other, with the result that, in certain terminal devices, a lot of time is required for the selection of a free channel. As a result, it takes too much time for the reception and display of the abnormality detection signals to be finally completed in the central unit.

In addition, it may happen, in such a conventional alarm system, that the so called PLL locking cannot be effected even when dividing ratio data is set in the PLL circuit of a terminal device for the purpose of effecting carrier sensing or transmission. The PLL locking is to be effected to allow the PLL loop to operate effectively to realize an oscillation-frequency-control condition corresponding to the dividing ratio. In this case, even a temporary malfunction caused by a noise, etc., may lead to a PLL locking failure, with the result that no transmission can be performed.

SUMMARY OF THE INVENTION

The present invention has been made in view of the above problems in the prior art. It is accordingly an object of this invention to provide a highly reliable radio alarm system which can reduce to the minimum the possibility of a simultaneous transmission by a plurality of terminal devices, which allows the search for a free channel through carrier sensing when re transmitting information from a terminal device to be performed in a short time, thereby making it possible for the reception and display of information from all the terminal devices to be quickly effected without any noticeable waiting time on the side of the central unit even if a plurality of terminal devices transmit an abnormality detection signal at the same time, and which allows transmission to be reliably performed even if the PLL circuit temporarily malfunctions.

In order to achieve this object, this invention provides a radio alarm system which comprises a plurality of terminal devices 12 each directly connected to a fire detector 10 and adapted to transmit information in the form of a radio signal based on an abnormality detection signal from the respective associated fire detector 10, and a central unit 14 which receives and decodes the radio signal from the terminal device 12 and gives an alarm.

In such a radio alarm system in accordance with this invention, delay times which vary from terminal device to terminal device are set, and the selection of a free channel for transmission is effected in each terminal device by performing carrier sensing over a delay time peculiar to that terminal device.

With this construction, a simultaneous transmission of abnormality detection signals can be avoided if two or more terminal devices detect an abnormality at the same time.

Further, each of the terminal devices 12 is equipped with a channel setting means 18 which successively performs, when transmitting information, carrier sensing on a plurality of transmission channels previously allocated the terminal device, in a previously determined order, thereby selecting a free channel which is not being used by any other terminal device; a transmission control means 26 which provides a rest of a certain period of time after performing the transmission of the above mentioned information for a certain period of time using the free channel found through the search by the channel setting means 18; and a re-transmission control means 91 which causes, when re-transmitting the above mentioned information at the end of a rest period provided by the transmission control means 26, the carrier sensing on transmission channels by the above-mentioned channel setting means 18 to be performed starting from the transmission channel used in the previous transmission.

With this construction, the search for a free channel through carrier sensing when re-transmission is to be effected by a terminal device is performed starting from the channel used in the previous transmission. Accordingly, it is quite unlikely that the channel used in the previous transmission be used by some other terminal device during a rest period, so that a free channel can be immediately selected to start transmission and the search for a free channel for re transmission can be performed efficiently in a short time.

Further, in accordance with this invention, each of the terminal devices 12 is equipped with a channel setting means 18, which performs channel setting automatically in accordance with preset terminal device addresses in such a manner that the channel on which carrier sensing is performed first varies from terminal device to terminal device.

With this construction, the channel on which carrier sensing is started first varies from terminal device to terminal device, so that no collision between signals occurs even if a plurality of terminal devices operate to transmit an abnormality detection signal, thus enabling the transmission of an abnormality signal to the central unit to be effected with a single carrier sensing operation and allowing the reception display on the side of the central unit to be effected quickly without involving any noticeable waiting time. Further, the channel on which carrier sensing is performed first is set automatically in each terminal device through the setting of the terminal device address, so that no channel setting operation for starting carrier sensing has to be performed, and no switch, etc. for channel setting is required.

In particular, the channel setting means may be provided with: a delay time setting counter 34, which is constantly repeating a clock counting operation; an information table 39 storing a series of values representing delay times in a pseudo random arrangement; and a delay time setting means 92 which performs delay time setting by reading enumerated data from the delay time setting counter 34 when an abnormality is detected and fetching a delay time from the series of values in the information table using the enumerated value thus read as an index parameter.

Further, the delay time setting means 92 may be so designed that, for each transmission from the second transmission onwards in a continuous transmission mode, it effects delay time setting by fetching the next delay time to the one previously fetched from the information table.

With this construction, the counting condition of the counter varies from terminal device to terminal device, so that, even if abnormality detection is effected simultaneously in two or more terminal devices, different positions in the series of values representing the delay times stored in the information table are accessed using different enumerated values as index parameters. The delay time setting is thus effected in the two stages: the counter enumerated values and the series of values, thereby substantially reducing the possibility of a simultaneous transmission through the same channel by a plurality of terminal devices.

Further, in the radio alarm system of this invention, a predetermined number of frequency channels (for example, eight), channels CH1 to CH8, are allocated to each of the terminal devices 12 each connected to a fire detector 10 for detecting an abnormality such as a fire, and, when any abnormality is detected by the associated detector of any one of the terminal devices 12, that terminal device 12 is set in a receiving state, and a carrier sensing is performed with a reception signal obtained through an oscillation generated by setting, in the PLL circuit 42 of the terminal device 12, dividing ratio data on a local oscillation frequency fr, thereby selecting a free channel which is not being used by any other terminal device. The terminal device 12 concerned is then switched over to a transmitting state and generates an oscillation by setting, in the PLL circuit 42, dividing ratio data on the carrier frequency ft of the selected free channel, thereby transmitting an abnormality detection signal to the central unit 14. The central unit 14 successively performs carrier sensing on the same predetermined number of channels as are allocated to each terminal device 12, i.e., on channels CH1 to CH8, and, when a carrier is detected in any of the channels, it fixes that channel in a receiving state to receive the abnormality detection signal.

Further, the radio alarm system may include a PLL control means 93, which is designed such that, if the PLL circuit 42 of the terminal device 12 fails to be locked when dividing ratio data for carrier sensing is set therein, it sets the dividing ratio data on the next channel, and that, if the PLL circuit fails to be locked when, in transmission, dividing ratio data is set therein for the purpose of generating an oscillation at the carrier frequency of the free channel, it repeats the setting of the same dividing ratio data a plurality of times until the PLL circuit is locked.

With this construction, the radio alarm system operates such that, if the PLL circuit fails to be locked when performing carrier sensing, a re-try operation is performed to set the dividing ratio data on the next channel, thereby remedying any temporary malfunction due to a noise, etc. and allowing the free channel to be reliably selected. Further, if the PLL circuit fails to be locked when performing transmission using the free channel obtained through carrier sensing, a re-try operation is performed to repeat the setting of the same dividing ratio data a plurality of times until the circuit is locked, thereby making it possible to reliably remedy any temporary malfunction of the PLL circuit caused due to a noise, etc.

DETAILED DESCRIPTION OF THE PREFERRED EMBODIMENTS

Figure 1:
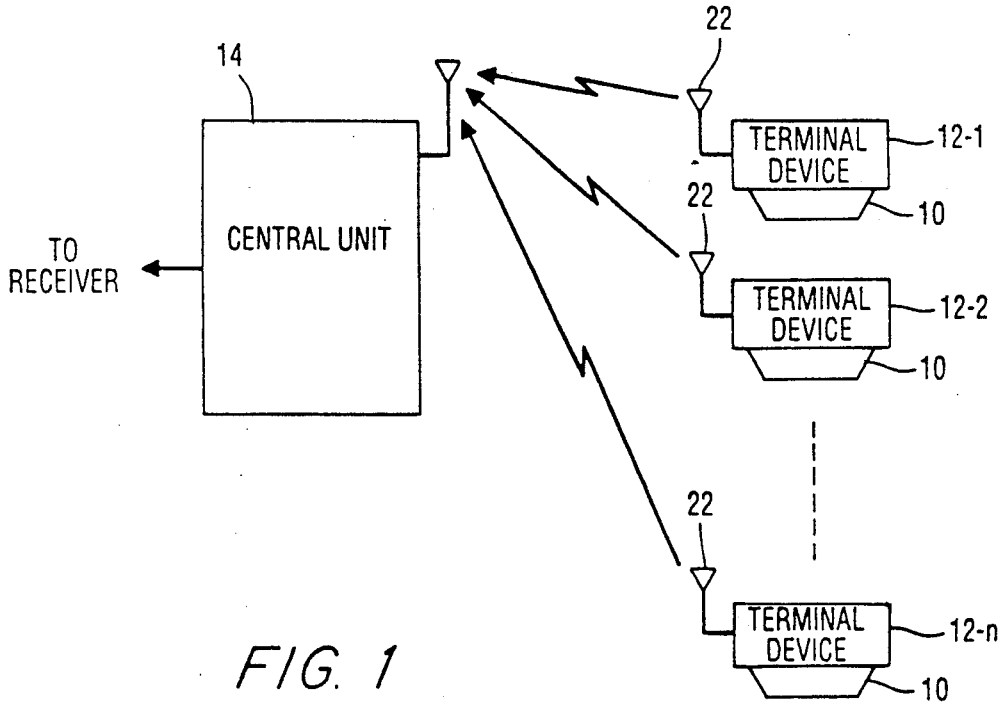
FIG. 1 is a block diagram showing a radio alarm system in accordance with a first embodiment of this invention.

FIG. 1 is a system block diagram showing the general construction of a radio alarm system in accordance with the first embodiment of this invention.

In FIG. 1, the reference numerals 12-1, 12-2, . . . , 12-n indicate terminal devices, each of which is connected to a fire detector 10. Each terminal device is adapted to transmit an abnormality detection signal, along with the terminal device address, through an antenna 22 to a central unit 14 when it receives a fire detection signal from the respective associated fire detector 10. In this embodiment, the maximum number of terminal devices that can be provided for one central unit is eight. That is, this embodiment allows the provision of a group of terminal devices consisting of eight terminal devices 12-1 to 12-8 for the central unit 14.

Allocated to each of the terminal devices 12-1 to 12-n are frequency channels the number of which corresponds to the maximum number of terminal devices that allows communication with the central unit 14. This number may, for example, be eight. Thus, eight frequency channels, channels CH1 to CH8, using a frequency band of 429 MHz, may be allocated to each of the terminal devices 12-1 to 12-n. Concretely 429.175 MHz is applied to CH1 and shifting 12.5 KHz every channel from it, that is, transmission is carried out applying 429.1875 MHz to CH2.

The terminal devices 12-1 to 12-n perform transmitting operation in the following manner: when an abnormality is detected in any one of the terminal devices, that terminal device is first set in a receiving state in order to check, through carrier sensing over a predetermined delay time, whether the channel frequency which is going to be used for transmission is being used by some other terminal device or not. Next, when it is ascertained through the carrier sensing that the channel frequency concerned is not being used by any other terminal device, the terminal device concerned is switched over to a transmitting state. Then, while the reception of the fire detection signal from the associated detector is going on, it transmits, in a continuous manner, an abnormality detection signal, along with the terminal device address, to the central unit 14 through the selected free channel by repeating a cycle of a transmission period of 8 sec. and a rest period of 2 sec..

In accordance with this invention, the above transmitting operation of the terminal devices 12-1 to 12-n is effected such that the channel on which the carrier sensing is performed first is different from terminal device to terminal device. The setting of this channel, on which the carrier sensing is performed first and which differs from terminal device to terminal device, can be effected automatically on the basis of preset addresses obtained by an address setting switch, which consists of a dip switch etc. provided in each of the terminal devices 12-1 to 12-n.

Figure 2A:
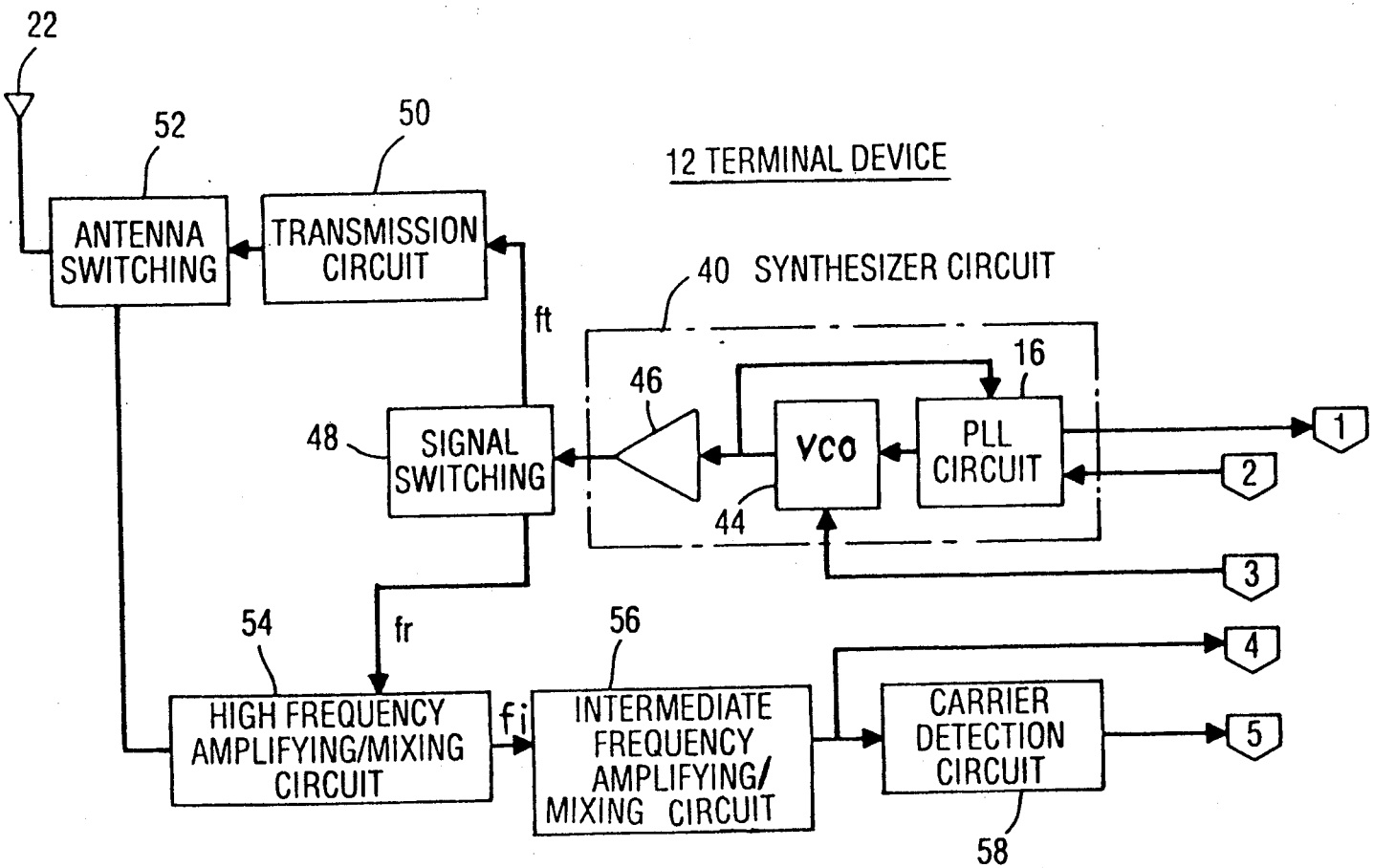
FIGS. 2(A) and 2(B) are block diagrams showing an embodiment of a terminal device in a radio alarm system in accordance with the first embodiment of this invention.
Figure 2B:
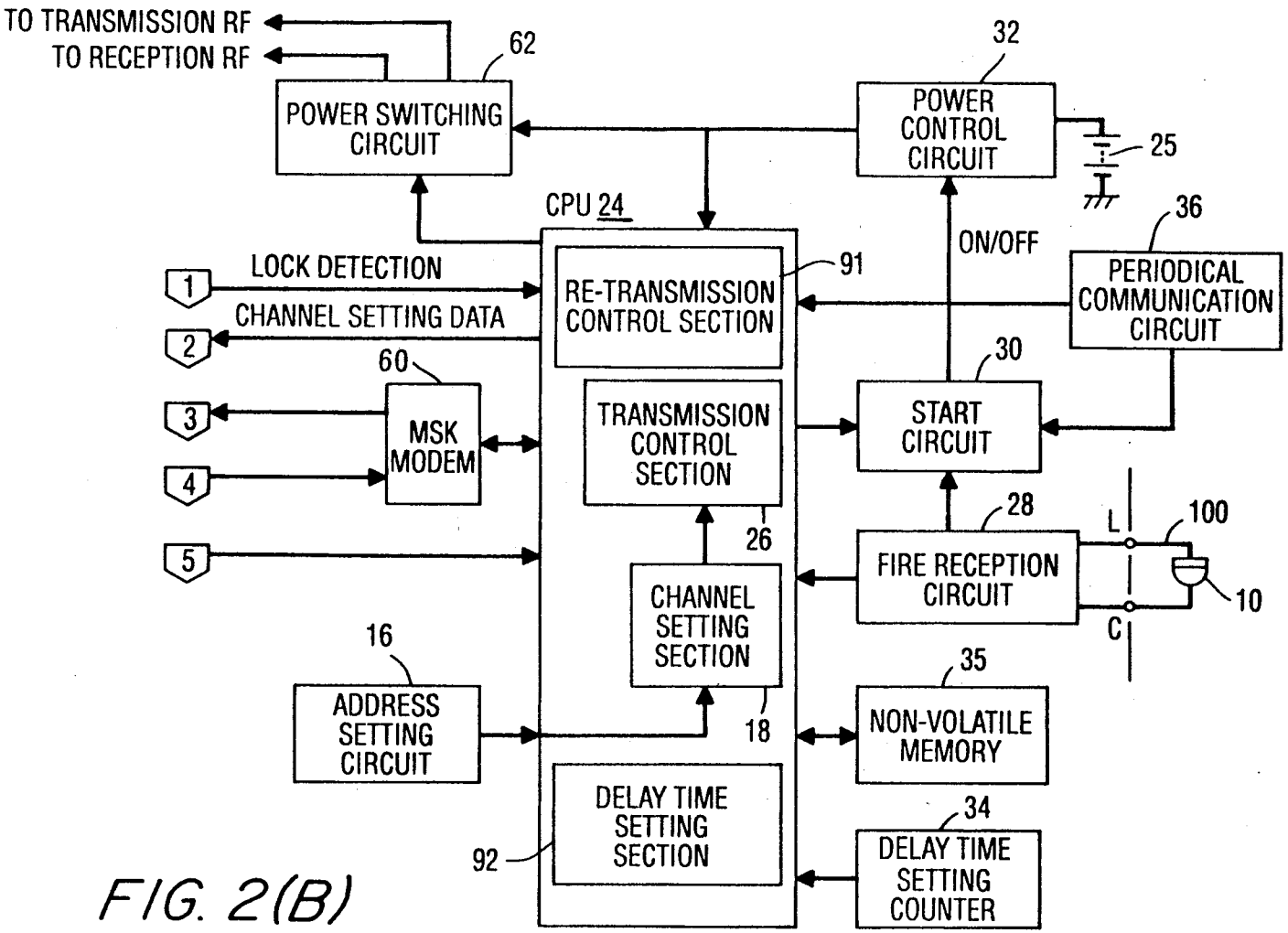

FIGS. 2A and 2B are an embodiment block diagram showing an embodiment of the terminal device of this invention.

In FIGS. 2A, 2B, the reference numeral 24 indicates a CPU, which is equipped with a transmission control section 26 adapted to effect transmission control by a programmed control function and a channel setting section 18 adapted to automatically set, on the basis of address setting information, the channel on which carrier sensing is to be performed first.

The reference numeral 28 indicates a fire reception circuit, to which a fire detector 10 is connected through a signal line 100, which also serves as a power line. When the fire detector 10 emits a detection signal, the fire reception circuit 28 receives it through the signal line 100, which also serves as the power line, and supplies a fire reception signal to the CPU 24 and to a start circuit 30. Upon receiving the fire reception output, the start circuit 30 turns on a power control circuit 32, and causes the CPU 24 to be supplied with power voltage from a battery power source 25, thereby effecting power on start of the CPU 24. This causes the transmission control section 26 to perform the operation of transmitting a fire detection signal.

The reference numeral 36 indicates a periodical communication circuit. This periodical communication circuit supplies a periodical communication output, for example, every nine hours, to the CPU 24 and the start circuit 30. This causes the power control circuit 32 to be turned on, and, with the power-on-start of the CPU 24, the transmitting operation of the periodical communication is started.

The reference numeral 16 indicates an address setting circuit, which comprises, for example, a dip switch. This address setting circuit 16 sets a group address and an individual address. The group address is set for a group consisting of one central unit and a plurality of terminal devices (for example, eight at the maximum), and the individual address is individually set for each terminal device.

The address information of the address setting circuit 16 is supplied to the transmission control section 26 as the terminal device address, and, at the same time, to the channel setting section 18 as the information for automatically setting the channel on which the carrier sensing is to be performed first.

Figure 3:
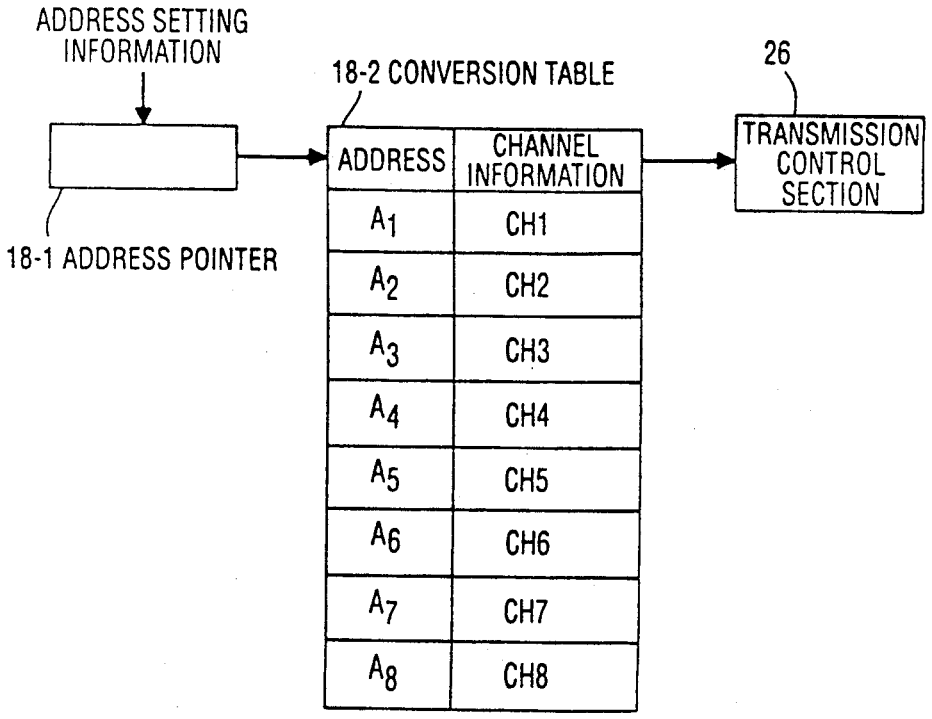
FIG. 3 is a block diagram showing an embodiment of a channel setting circuit for setting the channel on which carrier sensing is to be performed first in a radio alarm system in accordance with the first embodiment of this invention.

FIG. 3 is an embodiment diagram showing, in more detail, the channel setting section 18 that is provided in the CPU 24 of FIG. 2.

Referring to FIG. 3, the channel setting section 18 is composed of an address pointer 18-1 and a conversion table 18-2. Stored in the address pointer 18-1 is address setting information on the addresses set in the address setting circuit 16, i.e., the terminal device addresses. Stored in the conversion table 18-2 are items of channel information CH1 to CH8, which indicate, in correspondence with the terminal device addresses (the group and individual addresses) A1 to A8, the channel on which carrier sensing is to be performed first.

When address setting, which differs from terminal device to terminal device, has been effected by means of this address setting circuit 16, the address setting information thus obtained is stored in the address pointer 18-1. That is, the corresponding item of channel information is read by accessing the conversion table 18-2 by means of the address pointer 18-1. Accordingly, the channel on which the carrier sensing is to be performed first can be set automatically for the transmission control section 26.

Referring again to FIG. 2B, a non-volatile memory 35 is connected to the CPU 24. This non-volatile memory 35 may consist, for example, of EEPROM, which stores an officially authorized calling identification signal (ID code) to be transmitted first. In Japan, there is a requirement for special small power radio stations as specified by the Wireless Telegraphy Act that a calling identification signal be transmitted at the beginning of each transmission.

Connected further to the CPU 24 is a delay time setting counter 34. Based on the enumerated data obtained by this delay time setting counter 34, the setting of the delay time to be used in the terminal device when some abnormality is detected is effected.

Figure 4:
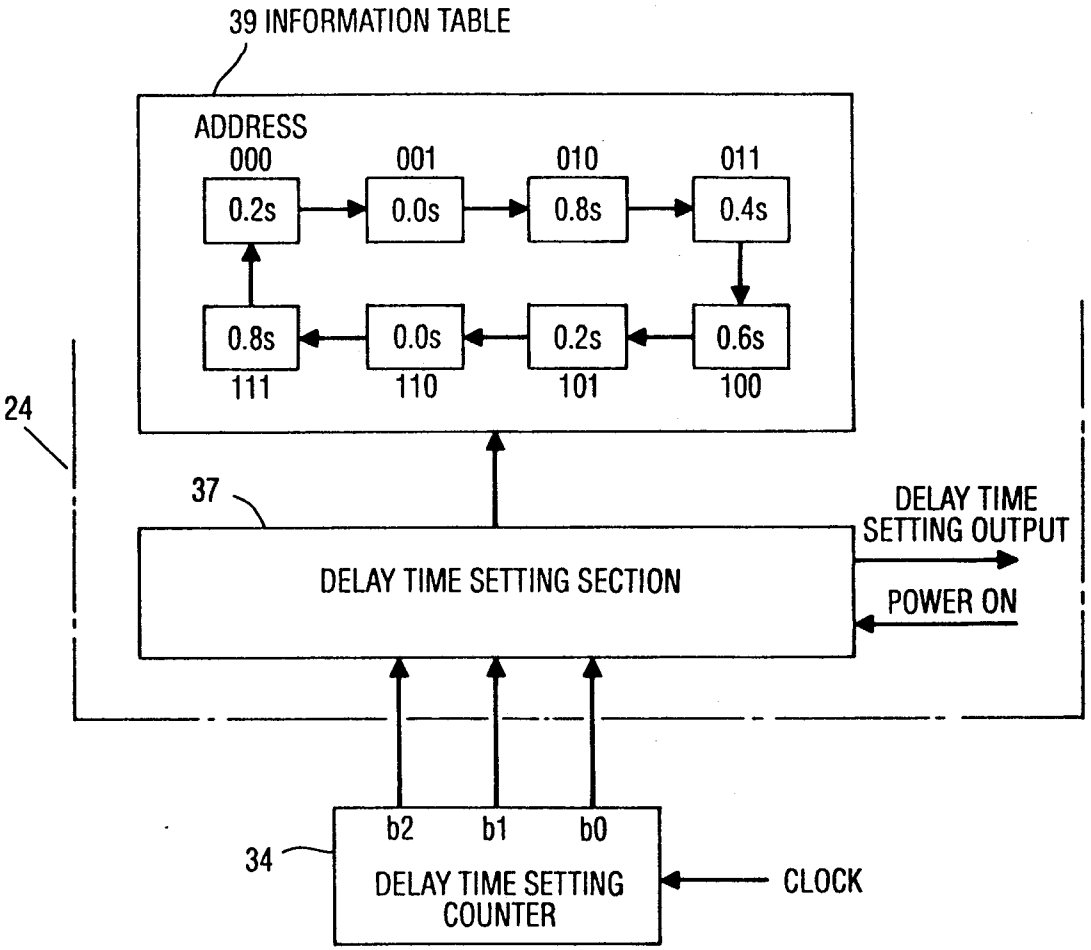
FIG. 4 is a block diagram showing an embodiment of a delay time setting circuit section in a radio alarm system in accordance with the first embodiment of this invention.

FIG. 4 is an embodiment block diagram showing the delay time setting counter 34 and the delay time setting means which is provided on the side of the CPU 24.

Referring to FIG. 4, the delay time setting counter 34 is constantly being supplied with power from the battery power source 25, and is successively repeating the operation of counting clocks, which are generated, for example, every two seconds. Specifically, this delay time setting counter consists of a counter circuit adapted to produce a binary 3-bit counting output (b2 b1 b0).

Provided on the side of the CPU 24 is an information table 39, which stores a series of values representing delay times in a pseudo-random arrangement, as shown in the drawing. In this embodiment, the series of values representing delay times are arranged such that a delay time of 0.2 sec. is stored at address 000, a delay time of 0.0 sec. at address 001, . . . , and a delay time of 0.8 sec. at address 111. The delay time setting counter 34 performs clock counting and produces a binary 3-bit output (b2 b1 b0), and supplies this counter output to a delay time setting section 37 in the CPU 24. The delay time setting section 37 starts to read the 3-bit output (b2 b1 b0) of the delay time setting counter 34 simultaneously with the power-on-start of the CPU 24 effected upon detection of a fire. It then performs read access using this counter output as an address pointer for the information table 39, and reads the delay time at the address corresponding to the counter output from the series of values, and sets this delay time thus read as the delay time to be used for the carrier sensing on that occasion.

Referring again to FIGS. 2A, 2B, provided on the left-hand side of the CPU 24 are a transmission and a reception circuit section.

These transmission and reception circuit sections include a synthesizer circuit 40, in which a PLL oscillation circuit is formed by a PLL circuit 42 and a VCO (voltage control oscillator) 44, and which emits the oscillation output of the VCO 44 through an amplifier 46. The above-mentioned PLL circuit 42 is equipped with a reference oscillator, a divider and a phase comparator, forming a PLL loop together with the VCO 44. As is well known, this PLL loop constitutes a phase locked loop which compares the division output of the reference oscillator with the division output of the VCO 44 and supplies the output of the phase comparator to the VCO 44, thereby performing feedback control such that the phase difference is reduced to zero. The oscillation frequency of the VCO 44 is controlled by changing the dividing ratio of the divider which is provided in the PLL circuit 42 and which is adapted to divide the output of the VCO 44.

This will be explained with reference to a concrete example. Assuming that the oscillation frequency of the reference oscillator is 12.8 MHz, a reference frequency of 12.5 KHz is derived through division using a fixed dividing ratio of 1/1024. In the case, for example, of the carrier frequency of channel CH1, which is 429.175 MHz, a frequency of 12.5 KHz is obtained by dividing the oscillation frequency of the VCO 44 using a dividing ratio of 1/34334. Then, the division output of the reference oscillator is compared with the division output of the VCO 44 by means of the phase comparator, and the oscillation frequency of the VCO 44 is controlled such that the phase difference is reduced to zero. Accordingly, the oscillation frequency of the VCO 44 can be arbitrarily changed through the setting, in the PLL circuit 42, of the dividing ratio supplied from the CPU 24. Thus, when performing the first carrier sensing, the CPU 24 sets the dividing ratio data such that an oscillation is produced at the local oscillation frequency needed for the reception operation in the carrier sensing for the channel frequency at which transmission is to be performed. When a free channel has been selected through the carrier sensing, the setting of the dividing ratio data is performed such that an oscillation is generated at the carrier frequency of the channel selected. Of course, the channel on which the first carrier sensing is performed is automatically set by the channel setting section 18, on the basis of the address setting information, in such a manner that the channel differs from terminal device to terminal device.

The output of the synthesizer circuit 40 is supplied through a signal switching device 48 to a transmission circuit 50 or to a high frequency amplifying/mixing circuit 54 provided on the reception side. The output of the transmission circuit 50 is supplied through an antenna switching device 52 to an antenna 22. The output emitted through the other output terminal of the antenna switching device 52 is supplied to the high frequency amplifying/mixing circuit 54. This high frequency amplifying/mixing circuit 54 effects frequency conversion on the received signal by the local oscillation frequency of the channel on which carrier sensing is to be performed. This local oscillation frequency is supplied from the synthesizer circuit 40 when performing carrier sensing. The high frequency amplifying/mixing circuit 54 then supplies the frequency converted signal to an intermediate frequency amplifying/mixing circuit 56 as an intermediate frequency signal fi. Specifically, assuming that the transmission frequency ft1 of channel CH1 is, for example, 429.175 MHz and the intermediate frequency fi from the high frequency amplifying/mixing circuit 54 is 21.7 MHz, the synthesizer circuit 40 gives, when performing carrier sensing on channel CH1, an oscillation at a local oscillation frequency fr1 of 407.475 MHz and supplies it to the high frequency amplifying/mixing circuit 54.

The intermediate frequency amplifying/mixing circuit 56 effects a frequency conversion to 455 KHz by means of a local oscillator adapted to give an oscillation at a fixed local oscillation frequency. This method, according to which frequency conversion is thus effected twice by means of the high frequency amplifying/mixing circuit 54 and the intermediate frequency amplifying/mixing circuit 56, is known as the "double super heterodyne system".

The output of the intermediate amplifying/mixing circuit 56 is supplied to a carrier detection circuit 58 and a modem 60. The carrier detection circuit 58 performs discrimination on the received signal in accordance with a threshold value based on the white noise level when there is no carrier, supplying a detection output indicating whether a carrier exists or not to the CPU 24.

The MSK modem 60 is adapted to convert received signals, whose respective frequencies are 1200 Hz and 1800 Hz, to data bits of 1 and 0, respectively. Further, it has a function of converting the data bits of 1 and 0 supplied from the CPU 24 to signals having frequencies of 1200 Hz and 1800 Hz, respectively. The frequency signals obtained from the data bits through conversion in the MSK modem 60 are supplied to the VCO 44 in the synthesizer circuit 40, where they are used for MSK modulation of the carrier frequency.

The reference numeral 62 indicates a power switching circuit, which is controlled by the CPU 24 and is adapted to perform the ON/OFF control of the power supply to the transmission circuit section and the power supply to the reception circuit section. That is, the power supply to the reception circuit section is turned on when performing carrier sensing. When a free channel has been selected through carrier sensing, the power supply to the reception circuit section is turned off, and then the power supply to the transmission circuit section is turned on.

The signal switching device 48 and the antenna switching device 52 are switched in such a manner that the circuit section which has been supplied with power from the power switching circuit 62 and set in the operating state becomes effective. That is, in this embodiment, the reception mode and the transmission mode are switched from one to the other through ON/OFF control of the power supply to the reception and transmission circuit sections.

Figure 5:
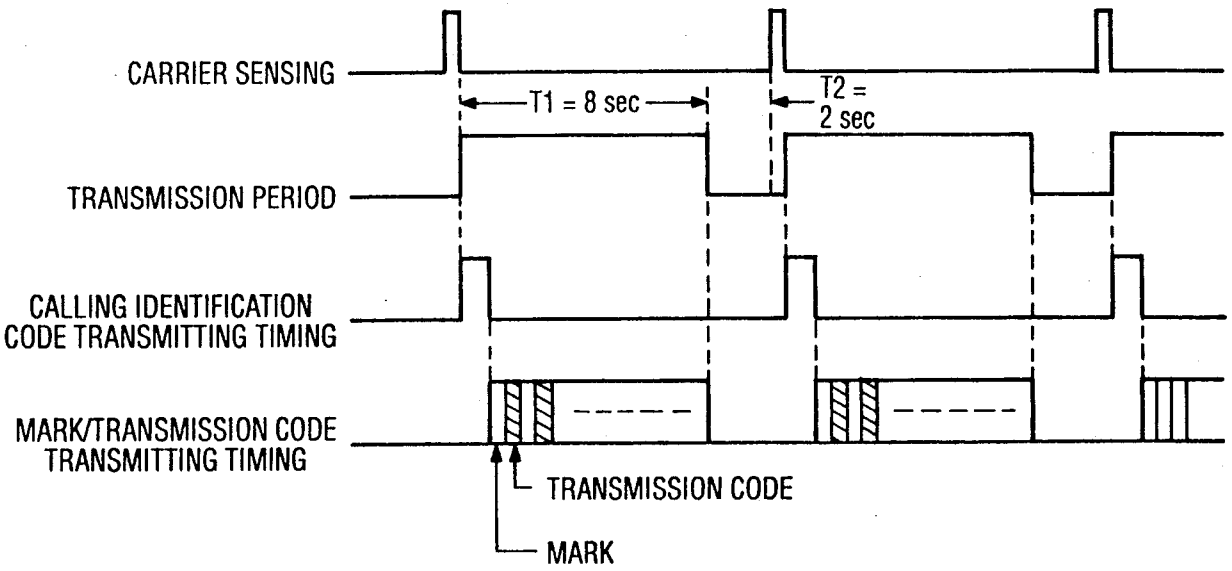
FIG. 5 is a transmission timing chart of a terminal device in a radio alarm system in accordance with the first embodiment of this invention.

FIG. 5 is a timing chart showing the continuous transmission operation when a fire is detected in the embodiment of the terminal device shown in FIG. 2.

Figure 6:
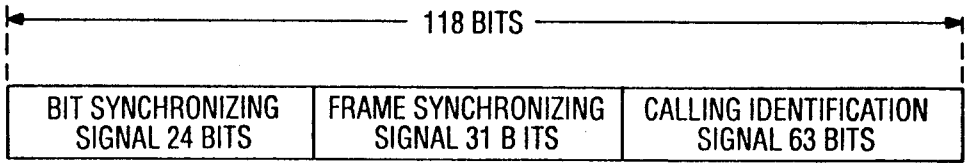
FIG. 6 is a diagram showing the format of a calling identification signal transmitted from a terminal device in a radio alarm system in accordance with the first embodiment of this invention.

Referring to FIG. 5, when a fire is detected in this terminal device, it is first set in the receiving state and performs carrier sensing starting from the automatically set channel, thereby selecting a free channel. After the selection of the free channel, the terminal device is switched over to the transmitting state and performs the transmission of a fire detection signal to the central unit during a transmission period T1 of 8 sec. Then, it rests for a period T2 of 2 sec. Afterwards, this cycle of transmission and rest is repeated. During the transmission period T1 of 8 sec., a calling identification code is first transmitted. FIG. 6 shows the format configuration of this calling identification code. When the transmission of the calling identification code has been terminated, the transmission of a mark and that of a transmission code are alternately repeated a plurality of times, as shown in FIG. 5. The mark entirely consists of data in the form of a sequence of 1-bits, whereas the transmission code is composed, for example, of four frames, i.e., frames 1 to 4, shown in FIG. 7.

Figure 7:
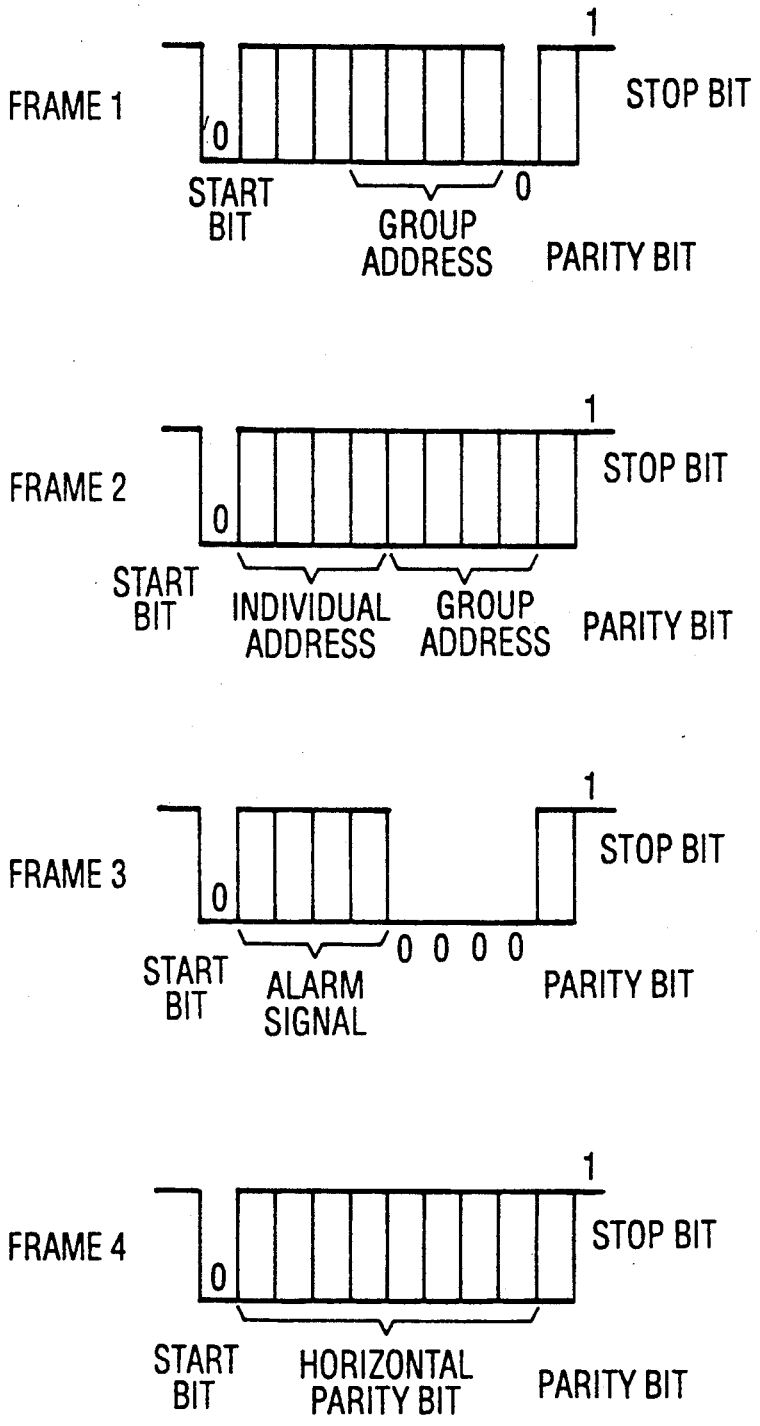
FIG. 7 is a diagram showing the format of a transmission code transmitted from a terminal device in a radio alarm system in accordance with the first embodiment of this invention.

Referring to FIG. 7, the start bit 0 at the head of each of frames 1 to 4 and the stop bit 1 at the end of the same are provided with a view to effecting frame synchronization. Provided subsequent to the start bit 0 is a data area of eight bits. In frame 1, a group address (a higher order address for expansion) is transmitted; in frame 2, an individual address and a group address (of a lower order) are transmitted; in frame 3, an alarm signal is transmitted; and in frame 4, a horizontal parity bit is transmitted. The horizontal parity bit of frame 4 is so set that the sum of the bits at the same bit positions of frames 1 to 3 is, for example, an odd number. Provided subsequent to the data area of eight bits is a parity bit of each frame unit.

Next, the transmitting operation in the terminal device shown in FIGS. 2A, 2B will be described with reference to the operational flowchart of FIGS. 8A, 8B, 8C.

Supposing that a signal has been emitted from the fire detector 10, the start circuit 30 is operated by the reception output of the fire reception circuit 28, and turns on the power control circuit 32 so as to cause the CPU 24 to be supplied with power from the battery power source 25. Then, through the power-on-start of the CPU 24, the operation flow of FIGS. 8A, 8B, 8C is executed.

Figure 8A:
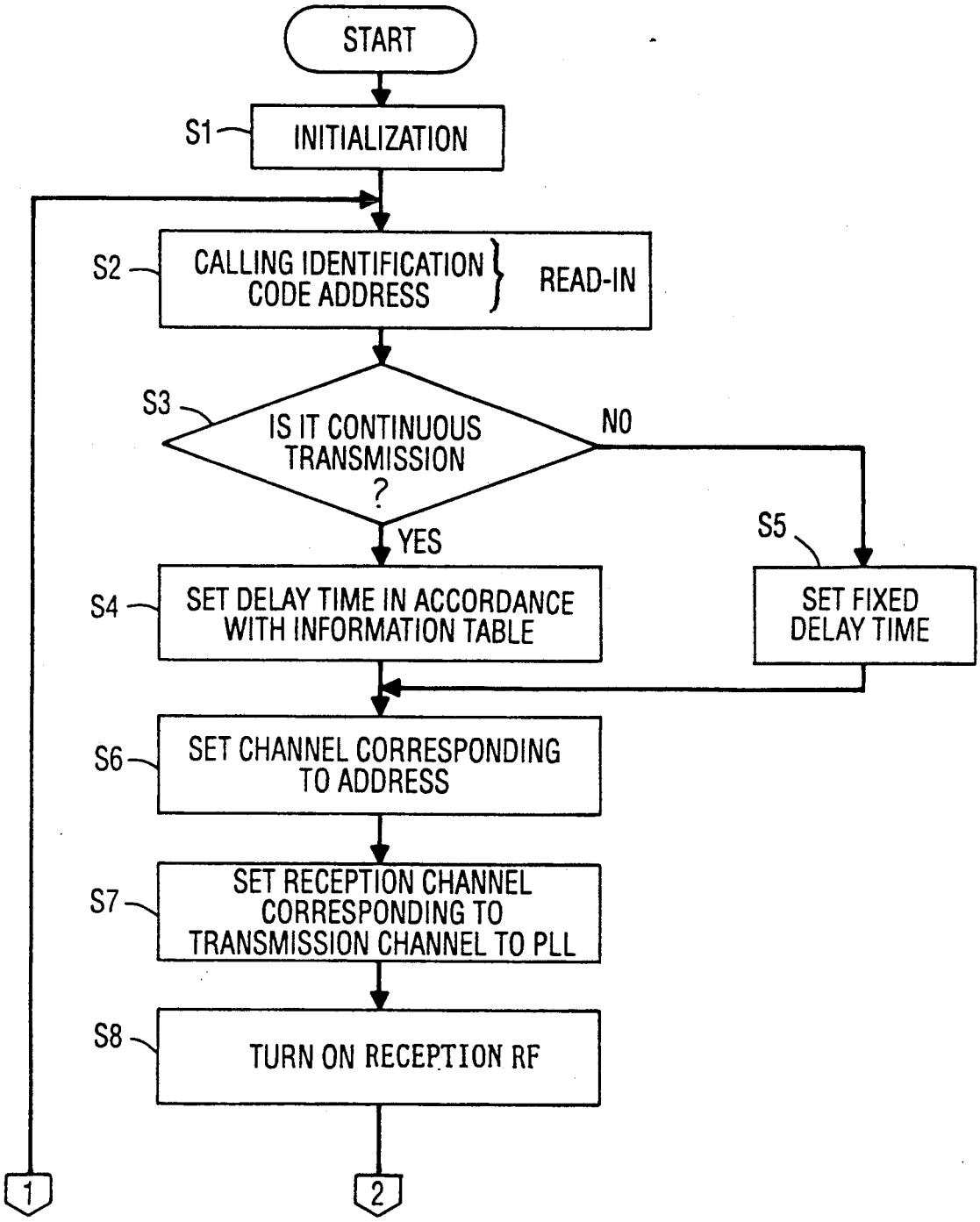
FIGS. 8A–8C are operational flowcharts showing the transmitting operation of a terminal device in a radio alarm system in accordance with the first embodiment of this invention.
Figure 8B:
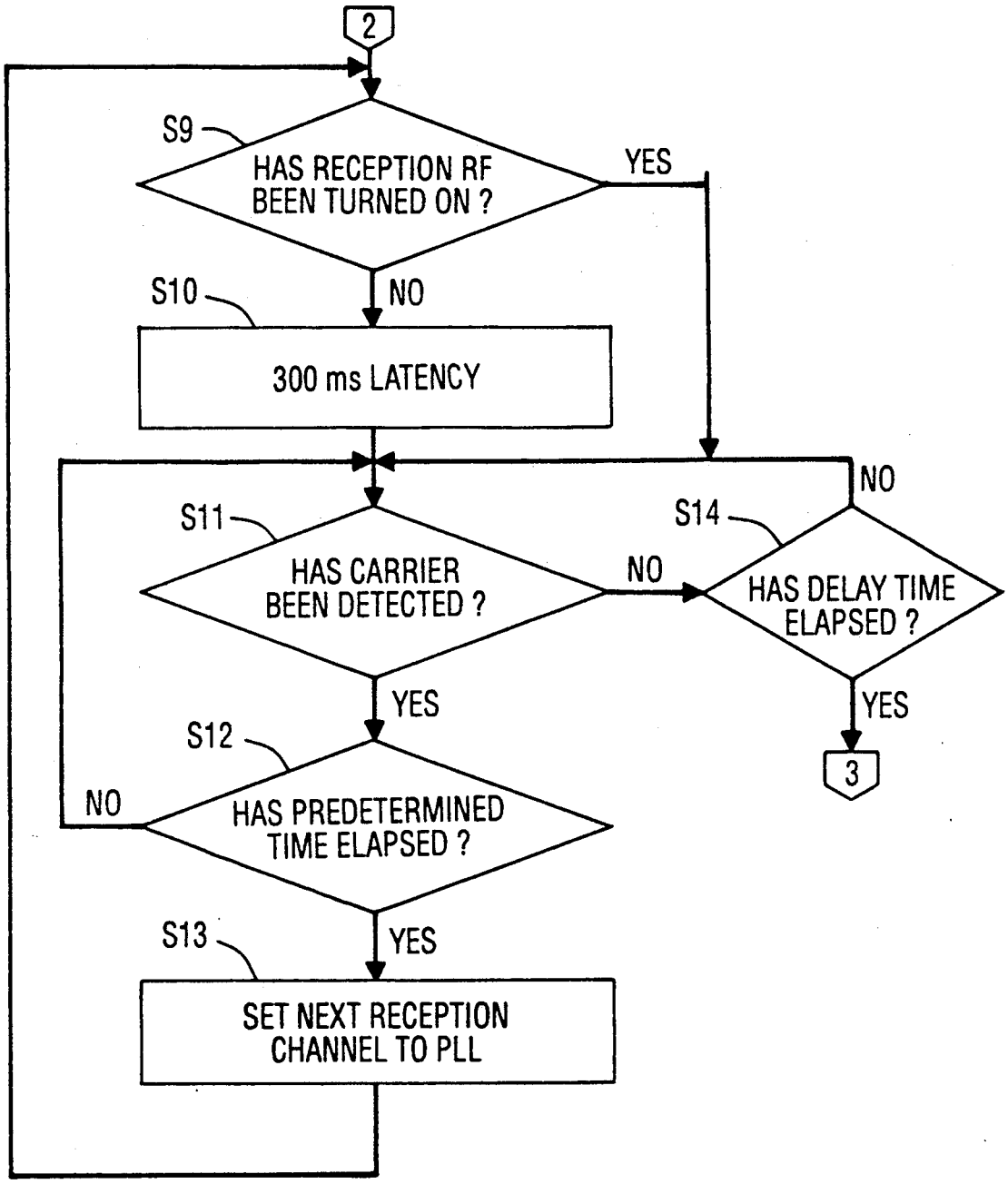
Figure 8C:
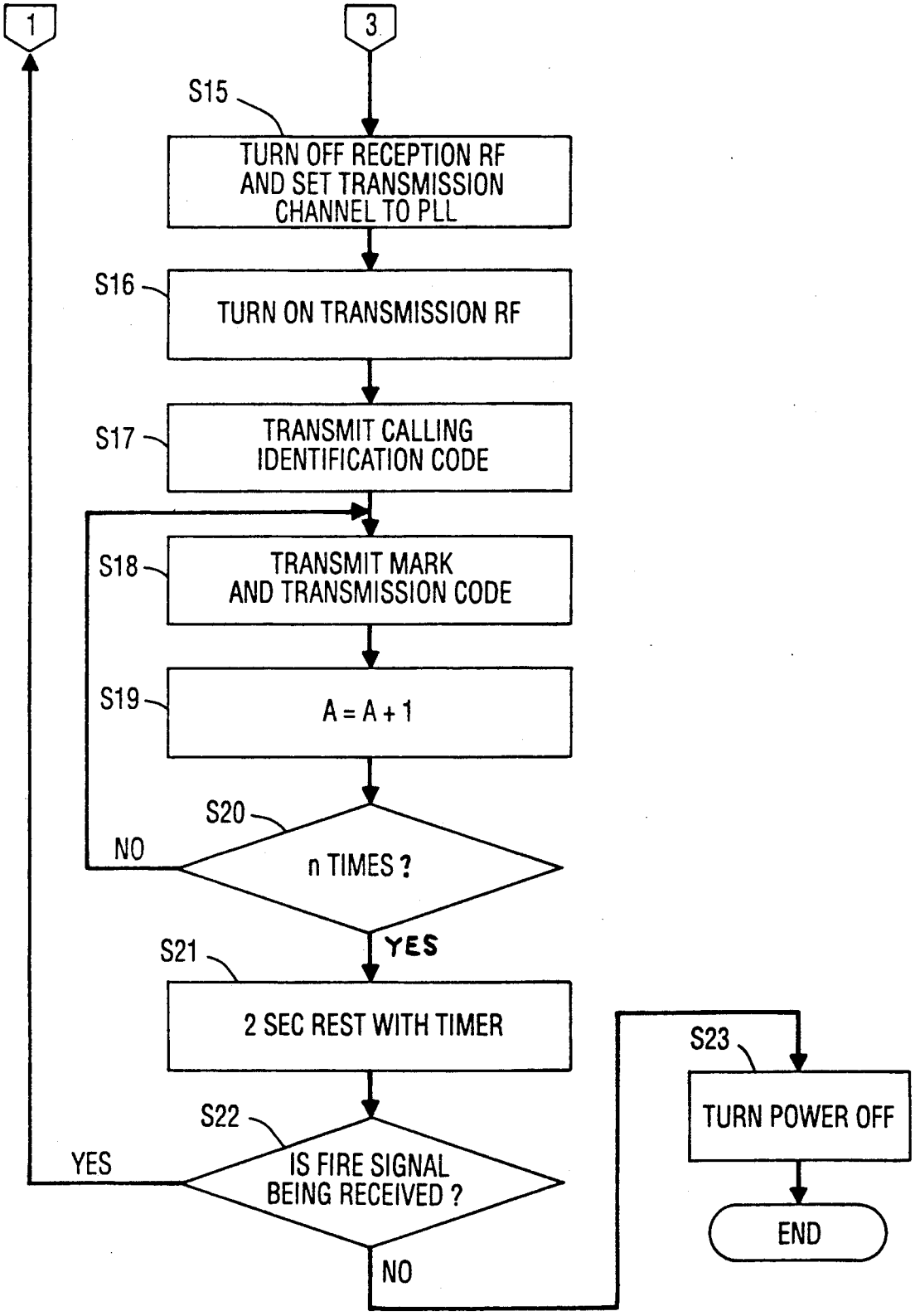

Referring to FIGS. 8A, 8B, 8C, initialization is first effected in step S1 (The word "step" will be omitted in the following). Next, in S2, the calling identification code and the terminal device addresses (the higher order group address, the lower order group address, and the individual address) are read from the non volatile memory 35 and the address setting circuit 16. Then, the procedure moves on to S3, where it is checked whether it is a continuous transmission or not. Since it is a continuous transmission that is performed when a fire is detected, the procedure moves on to S4. When power-on-start is effected by the periodical communication output supplied from the periodical communication circuit 36, it is not a continuous transmission that is to be performed, so that the procedure moves on to S5, where a fixed delay time is set.

In the case of the process in S4 for a continuous transmission, the counting output (b2 b1 b0) supplied from the delay time setting counter 34 at that time is read in the delay time setting section 37 through power-on-start of the CPU 24, as shown in FIG. 4. Then, using the counting output as an address pointer, the series of delay time values in the information table 39 is accessed, thereby reading and setting the corresponding delay time.

The procedure then moves on to S6, where the channel corresponding to the terminal device address, i.e., the channel on which the carrier sensing is to be performed first is set. That is, as shown in FIG. 3, the address pointer 18-1 stores the address setting information read in S2, and, the conversion table 18-2 is accessed in accordance with the address setting information of this address pointer 18-1. If it is, for example, address A1, channel CH 1 is set as the item of channel information on the channel on which carrier sensing to be performed first.

Next, the procedure moves on to S7, where the local oscillation frequency of the reception channel corresponding to the transmission channel set in S6 is set in the PLL circuit 42 for the purpose of performing carrier sensing.

Next, the procedure then moves on to S8, where the power supply to the reception circuit section is turned on to set it in the operating state. Then, in S9, it is checked whether the power supply to the reception circuit section has been turned on yet or not, i.e., whether it is the first power supply to the reception circuit section after the power-on-start. If it is the first power supply, the procedure moves on to S10, where a latency of 300 ms is provided so as to stabilize the operation of the reception circuit section. The procedure then moves on to S11.

In S11, a judgment is made as to whether any carrier has been detected or not. If no carrier has been detected, the procedure moves on to S14, where the expiration of the delay time is waited for, repeating the processes in S11 to S14 until the delay time expires. When it is found that no carrier has been detected over the delay time, the procedure moves on to S15. Then, after turning off the reception circuit section, the dividing ratio data for generating a transmission oscillation at the frequency of the channel selected with no carrier detected is set in the PLL circuit 42. Then, in S16, the power supply to the transmission circuit section is turned on, thereby setting it in the operating state.

Next, in S17, a calling identification code is first transmitted, and then, in S18, marks and transmission codes are successively transmitted. When the transmission has been terminated, the counter A to indicate the number of transmissions is by one in S19. Then, it is checked, in S20, whether transmission has been performed a predetermined number of times (A=n, which may, for example, be 75). When the transmission of the marks and data has been repeated 75 times, a two seconds' rest is effected in S21 by means of a timer, and the procedure moves on to S22, where it is checked whether the reception of a fire signal is going on or not. If the reception of a fire signal is going on, the procedure returns to S2, and the same transmitting operation is repeated. If the fire signal has been interrupted, the procedure moves on to S23, where a power-off process for interrupting the power supply to the CPU 24 is effected.

If a carrier is detected in the carrier detecting process in S11, the procedure moves on to S12, where it is checked whether the carrier detection is of a duration of more than a predetermined time or not. If it has been continued for more than a predetermined time, the procedure moves on to S13, and the dividing ratio data for giving an oscillation at a local oscillation frequency is set in the PLL circuit 42 for the purpose of preparing for the carrier sensing on the next reception channel, the procedure then returning to S9. Then, the carrier sensing on the next channel is started, repeating carrier sensing through channel change until a free channel is found.

Although in the transmitting operation shown in FIGS. 8A–8C. the delay time is also switched over to the next delay time to the one first read from the information table 39 when the carrier sensing has been switched over, in S13, to the carrier sensing of the next channel, this switching of the delay time may be omitted.

Figure 9A:
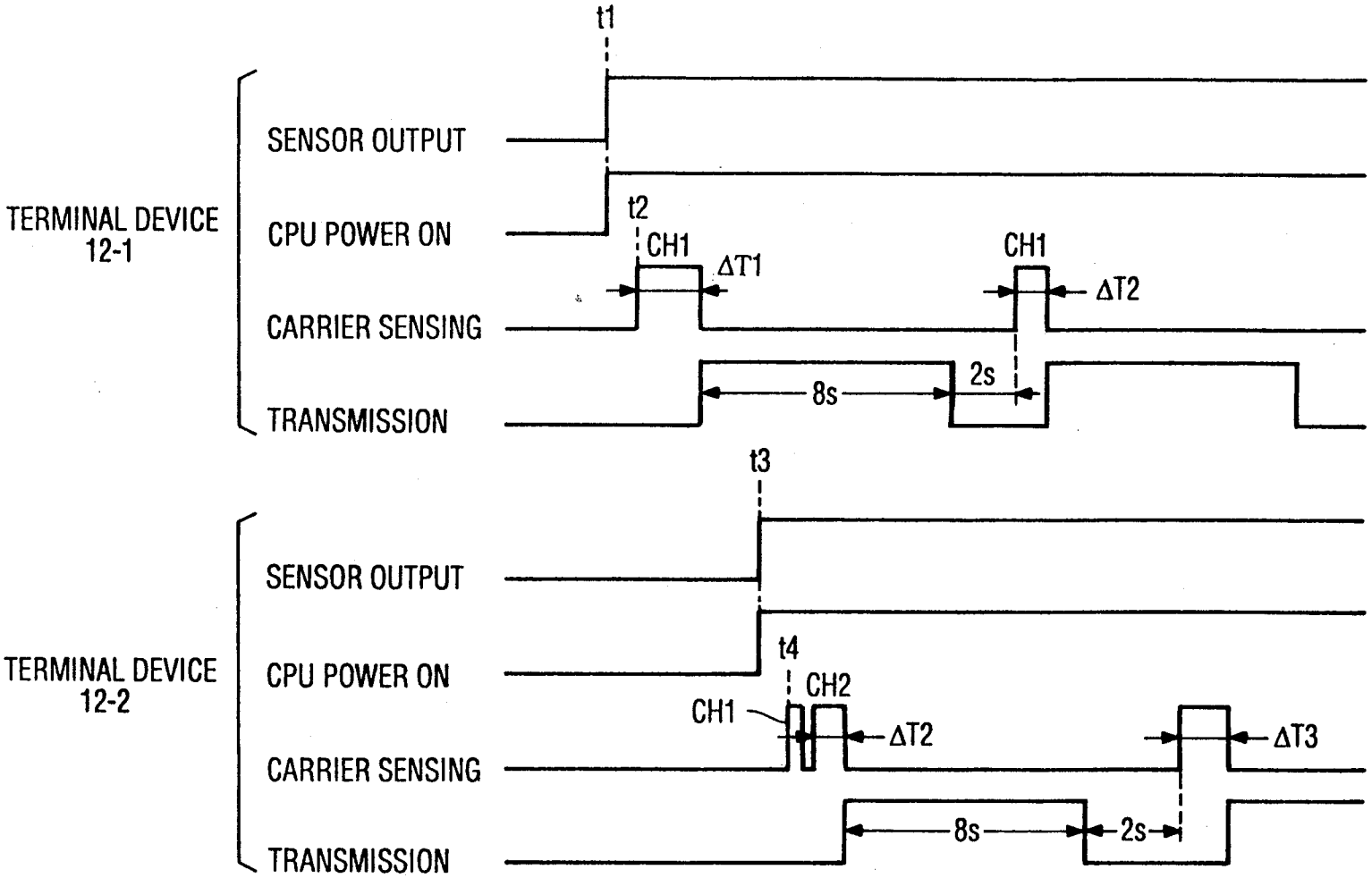
FIGS. 9A and 9B are a timing chart showing a concrete example of the transmitting operation of terminal devices based on delay times in a radio alarm system in accordance with the first embodiment of this invention when signal emission is simultaneously effected in two or more terminal devices.
Figure 9B:
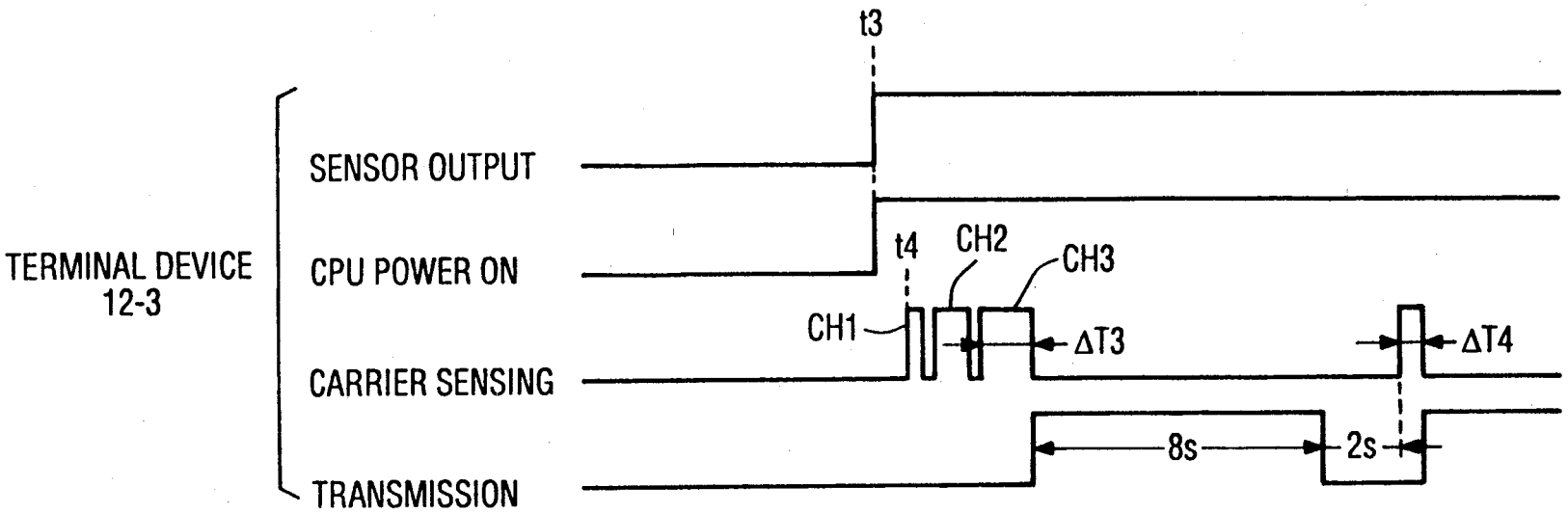

FIGS. 9A and 9B are a timing chart showing a case where the associated fire detector of the terminal device 12-1 emits a signal at time t1 to start the transmitting operation, and where the fire detectors of two terminal devices 12-2 and 12-3 emit a signal simultaneously at time t3, which is later than time t1, to start the transmitting operation.

First, in the terminal device 12-1, the fire detector thereof emits a signal at time t1 to start the transmitting operation, thereby causing power-on-start of the CPU 24 to be effected. Suppose, for example, address A=000 is designated and a delay time ΔT1 is set in accordance with the counting output of the delay time setting counter 34 at time t1. In this case, carrier sensing is performed for a period of the set delay time ΔT1 thus set starting from time t2. Since in this case no other terminal device is using channel CH1, this channel, CH1, is selected as a free channel, and after the delay time of ΔT1 has elapsed, transmitting operation is performed over a transmission period of eight seconds.

In the terminal devices 12-2 and 12-3, the respective associated detectors emit a signal at the same time, i.e., at t3, effecting power-on-start of the respective CPU 24. However, the respective delay time setting counters 34 provided in the terminal devices 12-2 and 12-3 are in a random counting condition because of the difference between them in terms of the time at which power supply is turned on.

For example, address A=001 in the information table 39 is set in accordance with the counting output of the terminal device 12-2, and delay time ΔT2 is read. In the terminal 12-3, address A=101 in the information table 39 is designated in accordance with the counting output of the delay time setting counter 34, setting a delay time of ΔT3. In the case of the carrier sensing of channel CH1 starting from time t4 on the basis of the delay times thus set, channel CH1 is already being used by the terminal device 12-1, so that the carrier sensing is switched over to that of the next channel, channel CH2, in both the terminal devices 12-2 and 12-3. Assuming that, with respect to channel CH2, the preset delay time on the side of the terminal device 12-2 terminates earlier, channel CH2 is selected as the free channel by the terminal device 12-2, starting transmitting operation. At this time, as the carrier of channel CH2 is detected by the terminal device 12-3 the carrier sensing of CH2 is canceled, so that the procedure moves on to the carrier sensing on the next channel, channel CH3. Since no terminal device is using channel CH3, the terminal device 12-3 starts transmitting operation after the delay time of ΔT3 expires.

As for the transmissions from the second transmission onwards, started after a two seconds' rest, carrier sensing is not performed starting from channel CH1. Instead, the carrier sensing for transmission is started from the channel selected in the previous carrier sensing.

Figure 10:
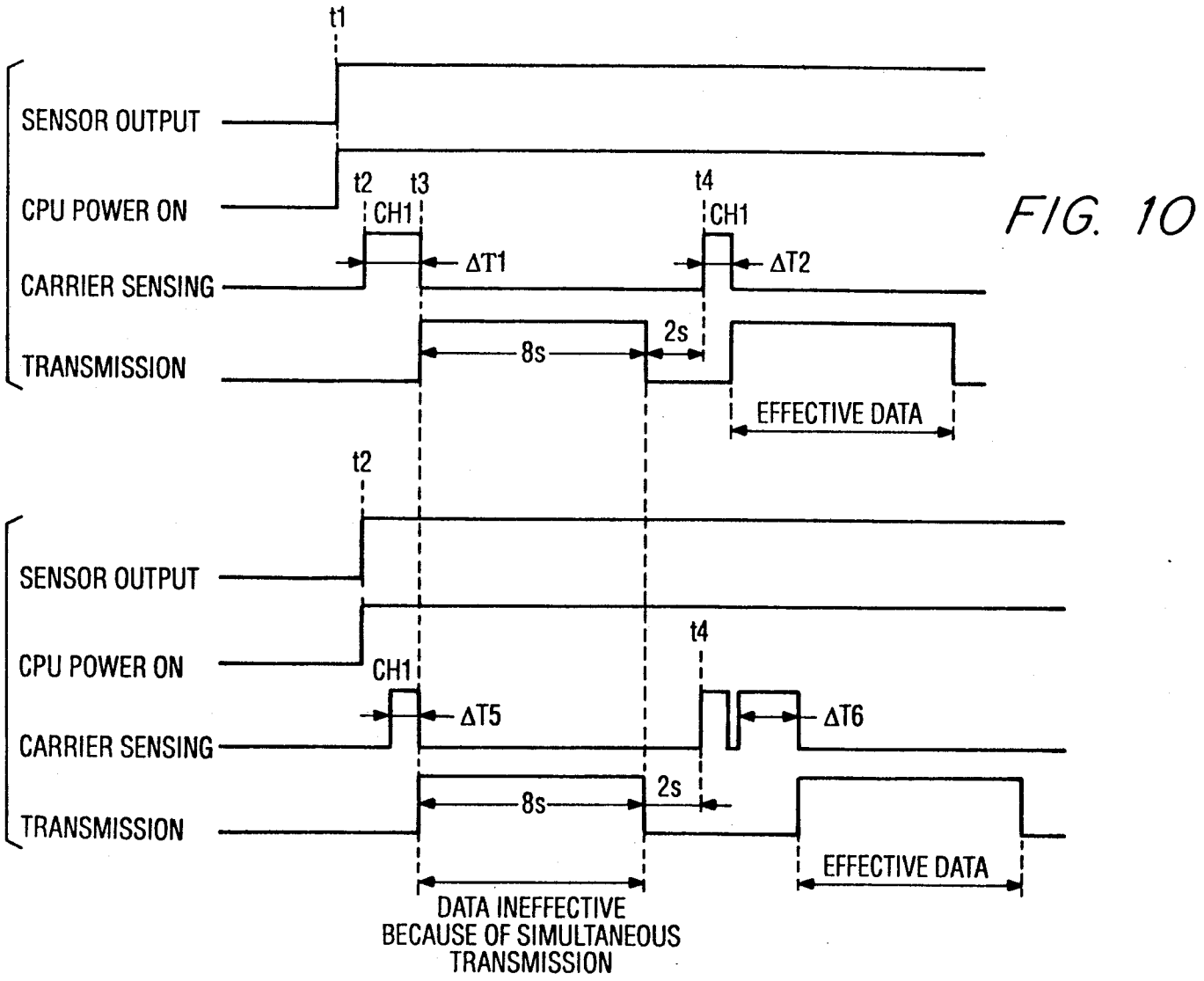
FIG. 10 is a timing chart showing a case where simultaneous transmission is effected by two or more terminal devices through the same channel in a radio alarm system in accordance with the first embodiment of this invention in spite of the setting of different delay times for two or terminal devices in view of simultaneous signal emission in them, the simultaneous transmission being caused by coincidence in delay time ending timing between terminal devices.

In the case shown in the timing chart of FIG. 10, different delay times have been set for the terminal devices 12-1 and 12-2, but, nevertheless, they have performed transmission simultaneously through the same channel since the time at which the preset delay time ends happened to be the same in these two terminal devices.

That is, in the case shown in FIG. 10, the respective associated detectors of the terminal devices 12-1 and 12-2 have emitted a signal at different times, t1 and t2. However, the lengths of the respective delay times ΔT1 and ΔT5 for carrier sensing happen to be such that they are terminated at the same time, t3. As a result, both terminal devices have selected the same channel, i.e., channel CH1, for transmission. In this case, the first transmission is effected simultaneously in both terminal devices, so that the data is regarded as ineffective on the side of the central unit and is not processed. However, in the case of the second transmission after a two seconds' rest, the carrier sensing start time is the same in the two terminal devices, as indicated at time t4. Accordingly, if different delay times are set for the two terminal devices, the carrier sensing over the delay time on the side of the terminal device 12-1 is terminated first, as shown in the drawing, and channel CH1 is selected as a free channel, thereby performing data transmission effectively. On the side of the terminal device 12-2, the carrier sensing output on channel CH1 can be obtained, so that effective data transmission can be realized by performing carrier sensing on channel CH2 and selecting it as a free channel.

Figure 11:
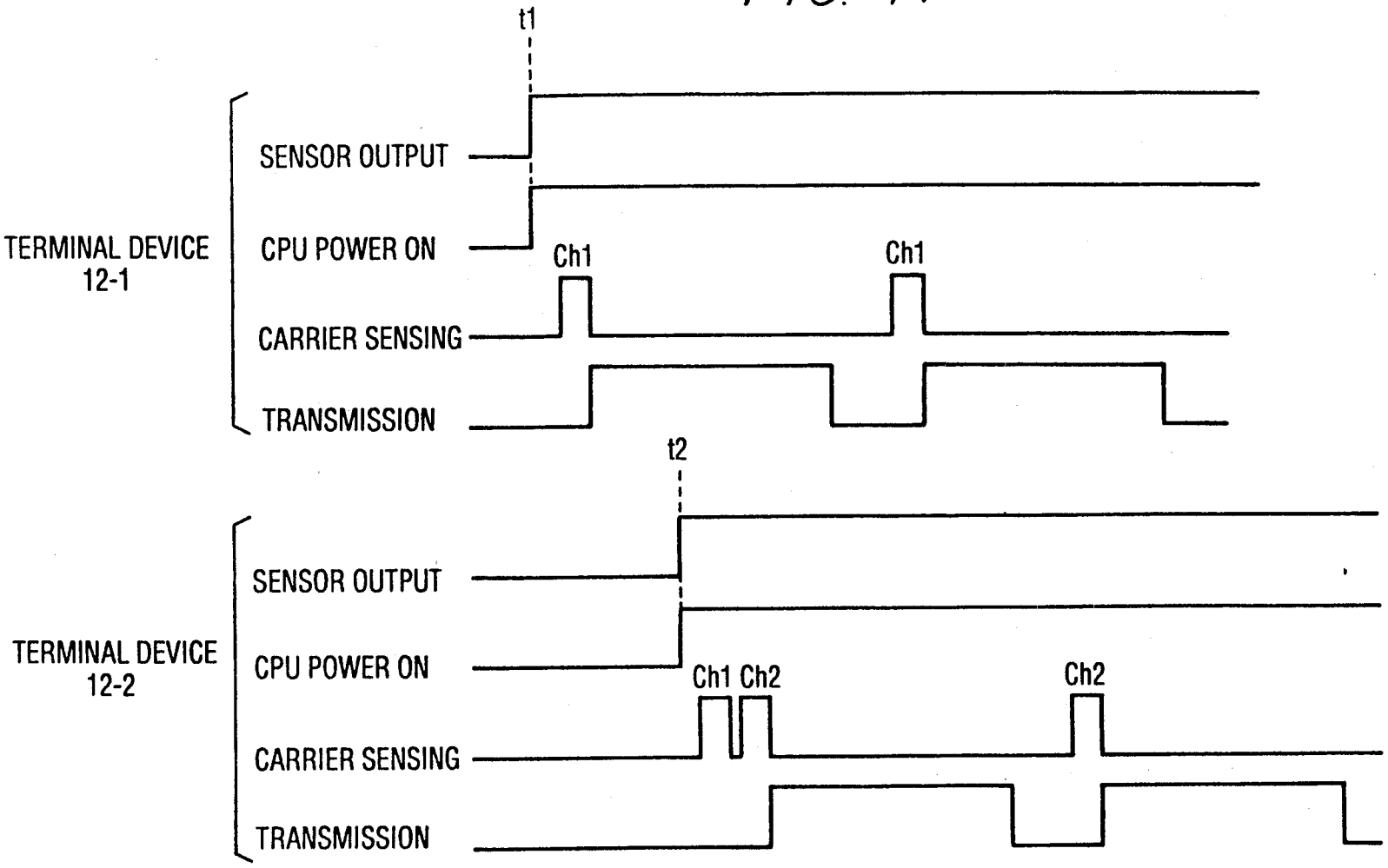
FIG. 11 is a timing chart showing the carrier sensing operation in a radio alarm system in accordance with the first embodiment of this invention when signal emission is simultaneously effected in two or more terminal devices.

FIG. 11 is a timing chart showing the re-transmitting operation performed when a fire is detected in connection with the terminal devices 12-1 and 12-2.

Suppose, in the case shown in FIG. 11, that the detector of the terminal device 12-1 emitted a signal first at time t1, and carrier sensing has been started by power-on-starting the CPU, selecting channel CH1 for transmission. Assuming that the detector of the terminal device 12-2 emits a signal at time t2, at which the transmission from the terminal device 12-1 is going on, and power-on-start of the CPU has been effected, carrier sensing is first performed on channel CH1. Since, however, the channel has a carrier, the carrier sensing is switched over to that of channel CH2, selecting channel CH2 as a free channel to perform transmitting operation.

As to the second transmitting operation, channel CH1 is selected through carrier sensing as a free channel to perform transmission, as in the first transmission, since the channel for starting carrier sensing is the same channel used in the previous transmission, i.e., channel CH1.

In the case of the terminal device 12-2, the channel used in the previous transmission is CH2, so that carrier sensing is started from the channel used in the previous transmission, i.e., channel CH2, immediately selecting channel CH2 as a free channel to start transmitting operation. In prior art systems, the search for a free channel is effected by performing carrier sensing starting from channel CH1 for the second transmission as well as for the first one, with the result that the search takes a rather long time. This problem has been solved by the present invention.

Figure 12:
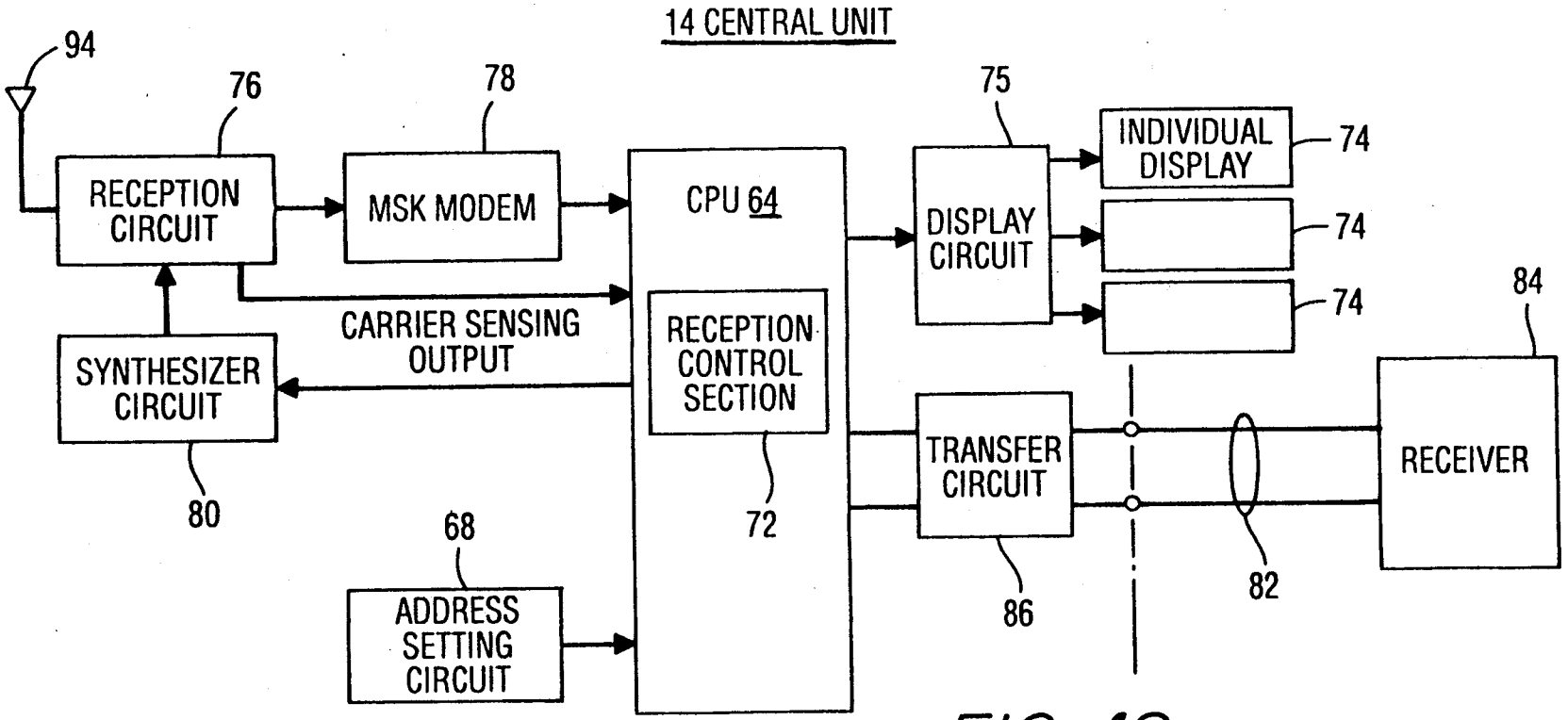
FIG. 12 is a block diagram showing an embodiment of the central unit of a radio alarm system in accordance with the first embodiment of this invention.

FIG. 12 is an embodiment block diagram showing the construction of an embodiment of the central unit of this invention.

Referring to FIG. 12, the central unit 14 is equipped with a CPU 64. Through program control of this CPU 64, a reception control section 72 is formed. Further, connected to the CPU 64 is an address setting circuit 68 comprising a dip switch, etc. The address setting circuit 68 serves to set all of the terminal device addresses.

As the reception circuit section for the CPU 64, an antenna 94, a reception circuit 76, an MSK modem 78, and a synthesizer circuit 80 are provided. The transmission circuit section of this central unit has substantially the same construction as that of the transmission/reception circuits of the terminal device shown in FIGS. 2A and 2B except for the transmission side thereof.

The reception control section 72 of the CPU 64 successively changes the respective local oscillation frequencies of channels CH1 to CH8 through the setting of dividing ratio data in the synthesizer circuit 80 and supplies them to the reception circuit 76, thereby repeatedly performing carrier sensing on channels CH1 to CH8. When a carrier sensing output is supplied from the reception circuit 76, the reception control section 72 stops the switching of the setting of the dividing ratio data in the synthesizer circuit 80, and sets the channel concerned in a fixed receiving state. Then, the signal received in this receiving state is converted to data bits by the MSK modem 78, the dat bits thus obtained being supplied to the CPU 64. The reception control section 72, which has received reception data, first performs address collation. This address collation is performed in order to check whether the group address contained in the reception data coincides with the group address on the side of the central unit. When the coincidence of the group addresses has been ascertained, address collation is then successively performed in order to check whether the individual address contained in the reception data coincides with any one of the respective individual addresses of the terminal devices as preset on the central unit side. If it coincides with any one of the individual addresses, the reception data is decoded. The decoding of this reception data is effected as follows: the data area of frame 3 shown in FIG. 7 is first decoded, and, if it is fire detection information, an individual display indicating the terminal device address and fire outbreak is made on one of a plurality of individual displays 74 through a display circuit 75. Of course, a fire alarm lamp (not shown) is lighted and an alarm buzzer is sounded. Further, in the case where a receiver 84 is connected to the central unit through a transmission line 82, a fire alarm can be given also on the side of the receiver 84 through a transfer output obtained by a transfer circuit 86.

In the receiving operation of this central unit 14, an automatic setting is made on the side of the terminal devices of this invention in such a manner that, when the terminal devices operate all at once on the occasion of a test or the like, the channel on which carrier sensing is performed first differs from terminal device to terminal device in accordance with the terminal device addresses. Accordingly, the free channel selection may be completed in all the terminal devices with a single carrier sensing operation, test signals being transmitted all at once through different channels. Therefore, in the central unit 14, a carrier sensing output is obtained from the reception circuit section 76 by performing carrier sensing on channels CH1 to CH8, and the operations of address collation, data analysis, and test display on the received data as well as the switching over to the next channel reception are performed in a continuous manner. The carrier sensing, the address collation, and the data analysis/display for one reception terminal can be effected in a processing time in the order of miliseconds, so that the information transmitted from all the terminal devices can be received and displayed without involving any noticeable reception waiting time.

Figure 13A:
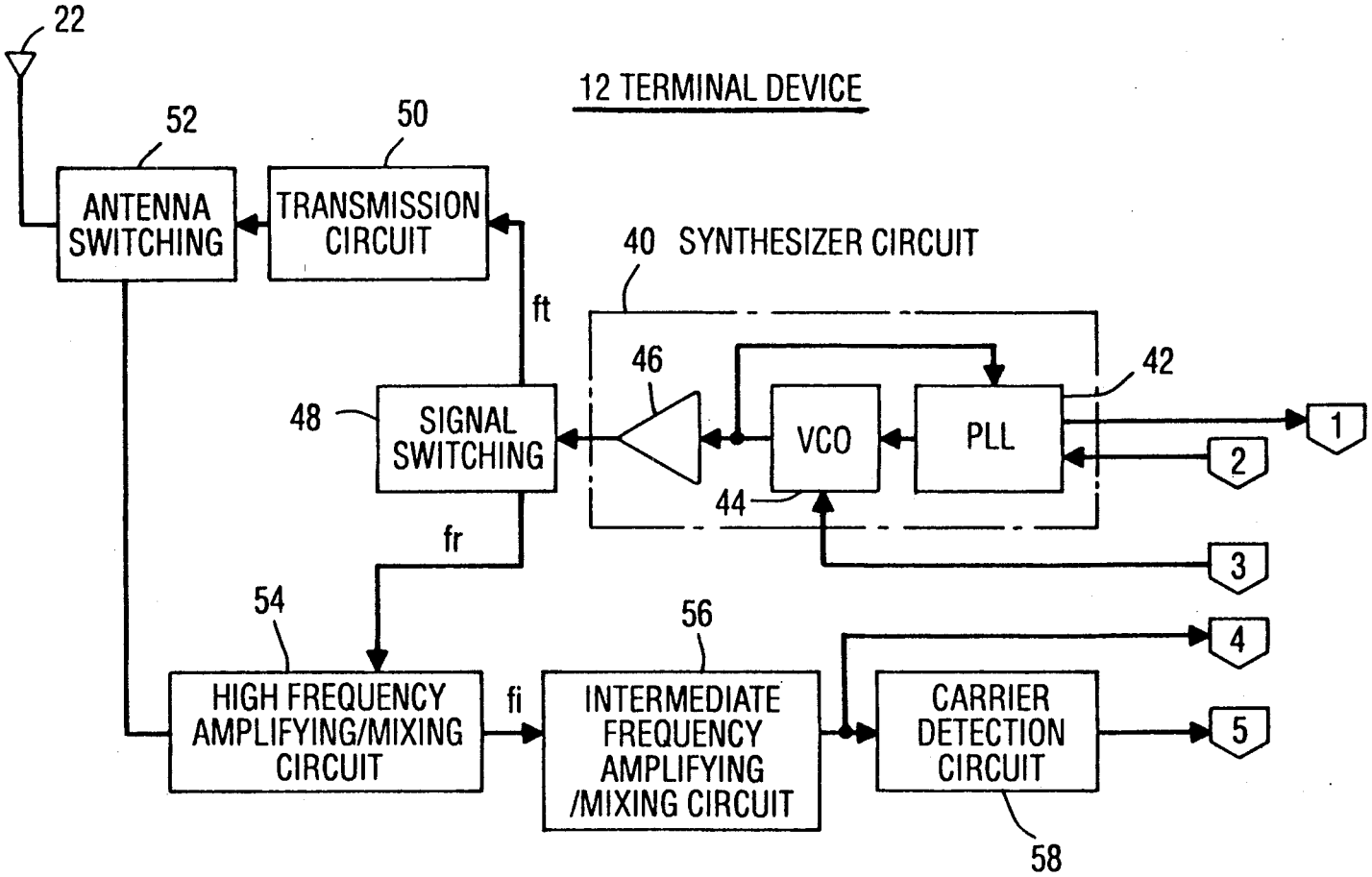
FIGS. 13A and 13B are a block diagram showing a second embodiment of a terminal device in the radio alarm system of this invention.

FIGS. 13A, 13B are an embodiment block diagram showing another embodiment of a terminal device in the system of this invention.

Figure 13:
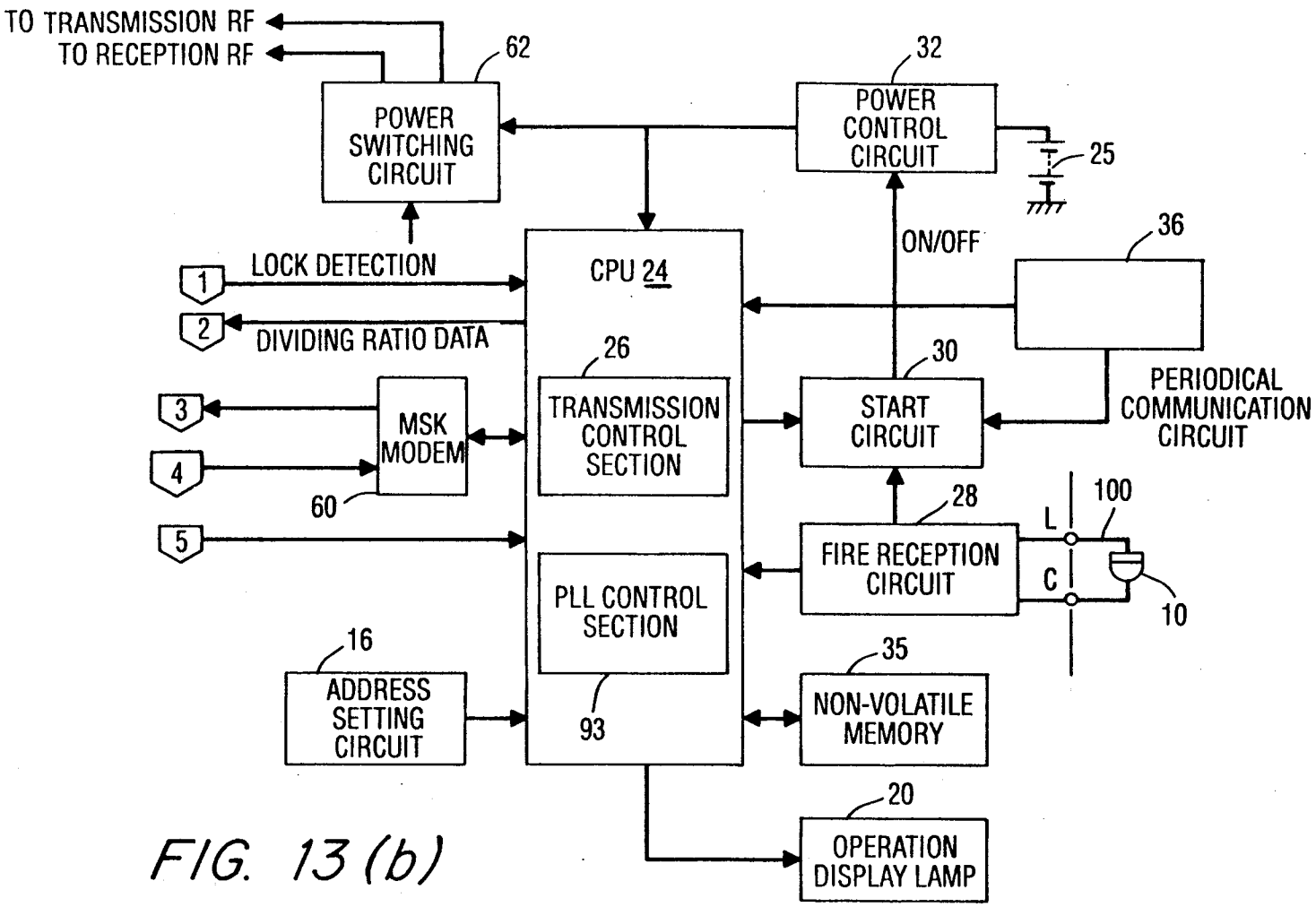

The terminal device shown in FIG. 13 has a construction which is substantially identical to that of the above-described embodiment. In this embodiment, however, the CPU 24 is equipped with a PLL control means 93.

In this embodiment, the transmission control section 26 of the CPU 24 first sets, when performing carrier sensing prior to transmission, dividing ratio data for giving an oscillation at the local oscillation frequency fr1 of channel CH1, in the PLL circuit 42, and checks whether there is any detection output from the carrier detection circuit 58 or not. If no detection output is obtained from the carrier detection circuit 58, the channel is judged to be a free channel, and the dividing ratio of the carrier frequency ft1 of channel CH1 is set, for the purpose of performing transmission, in the PLL circuit 42 so as to effect an oscillation. When a detection output is obtained from the carrier detection circuit 58, the dividing ratio data on the local oscillation frequency fr2 of the next channel, i.e., channel CH2, is set in the PLL circuit 42, repeating channel switching until a free channel is found.

The PLL control section 93 serves as a monitor to check whether the locking of the PLL circuit 42 is effected or not in consequence of the setting of the dividing ratio data in the PLL circuit 42 by the transmission control section 26. When the PLL circuit 42 cannot be locked when the setting of the dividing ratio data for performing carrier sensing is effected, an instruction to set the dividing ratio data for receiving the next channel is given to the transmission control section 26. In the case where it is found that the PLL circuit 42 cannot be locked even if the dividing ratio data is set when performing transmission using the free channel selected, an instruction is given to the transmission control section 26 to repeat the setting of the same dividing ratio data a predetermined number of times.

Next, the transmitting operation of the terminal device shown in FIGS. 13A, 13B will be described with reference to the operational flowchart of FIGS. 14A–14C.

Figure 14A:
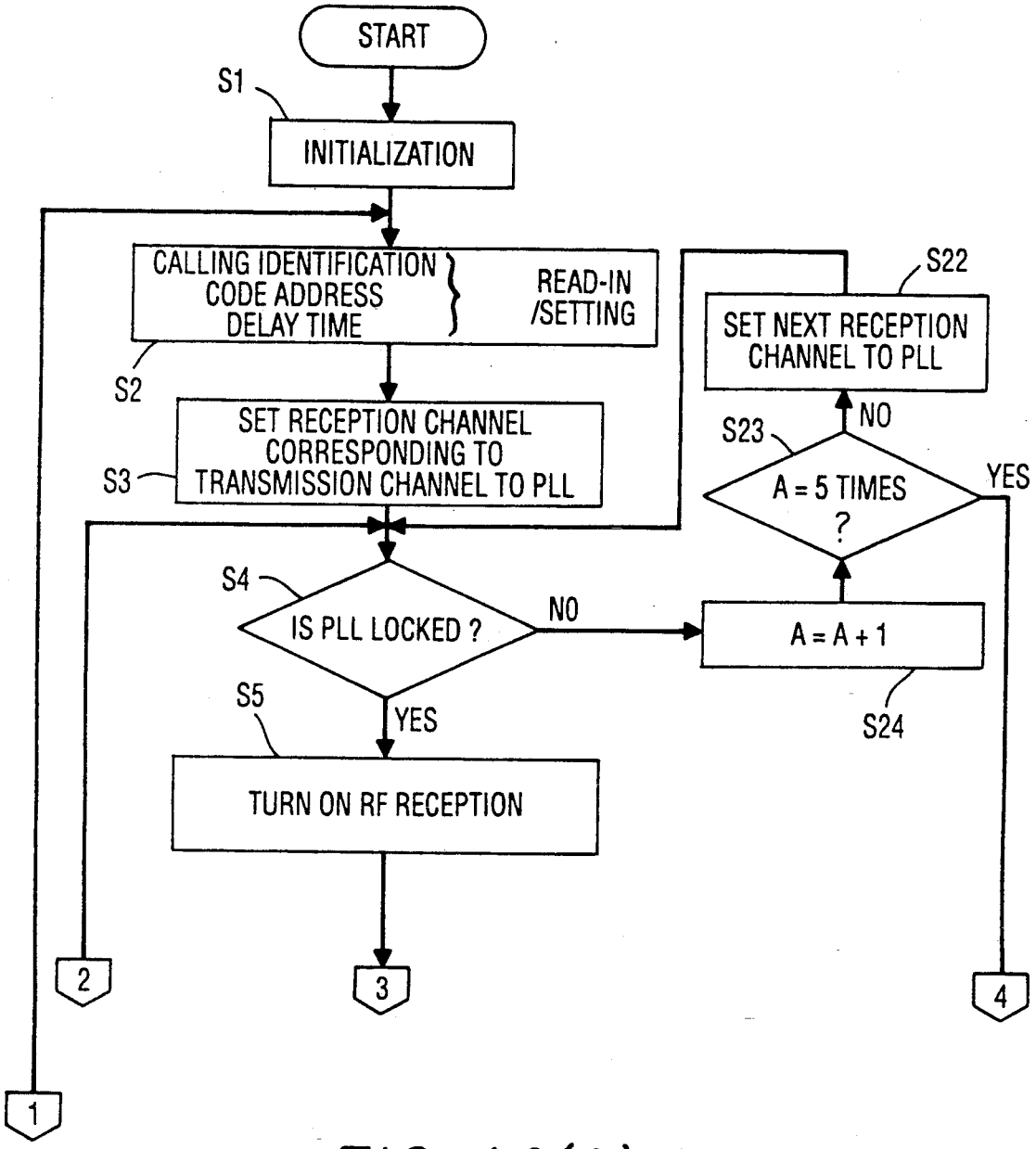
FIGS. 14A–C are operational flowcharts showing the transmitting operation of a second embodiment of a terminal device in the radio alarm system of this invention.
Figure 14B:
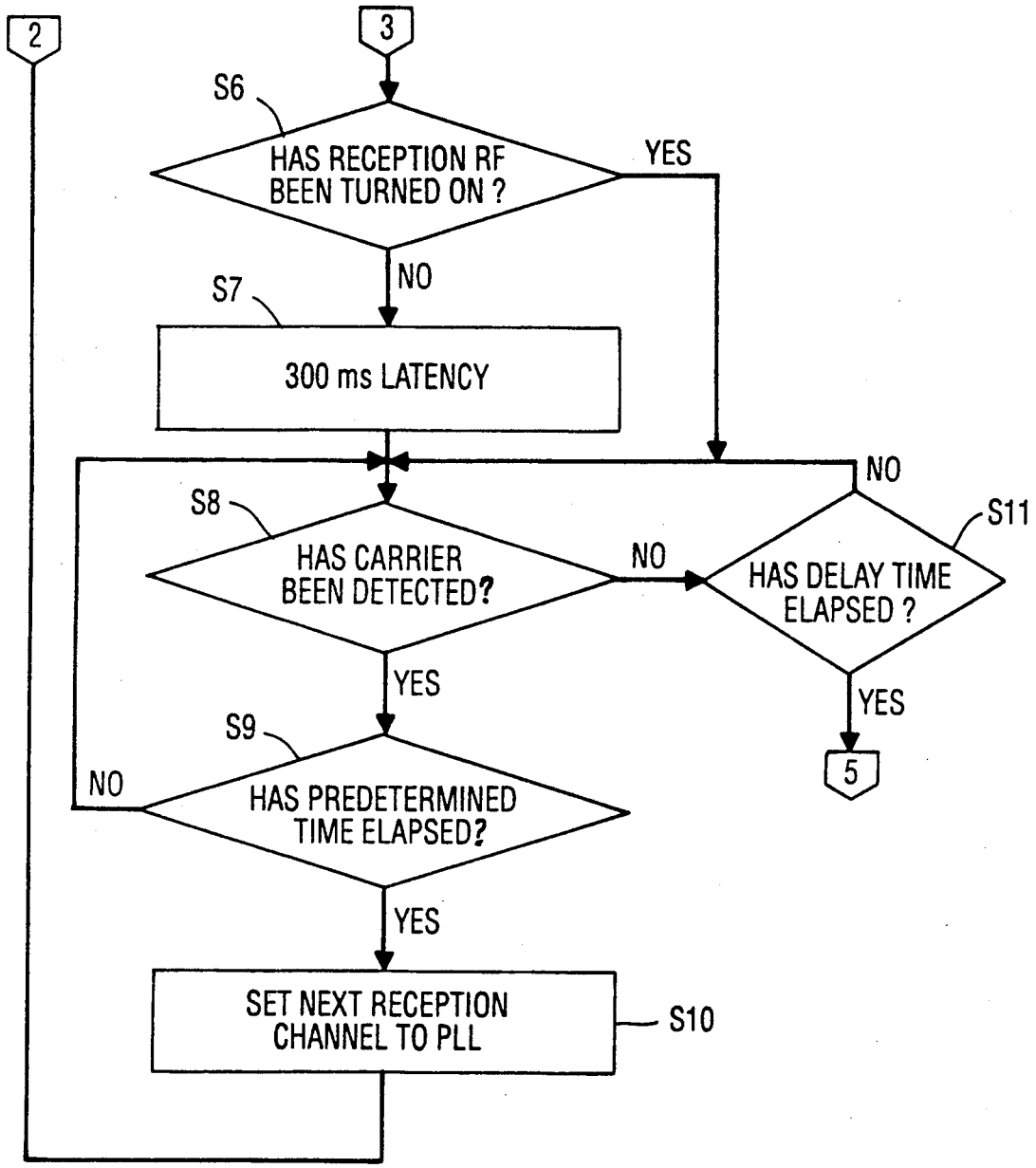
Figure 14C:
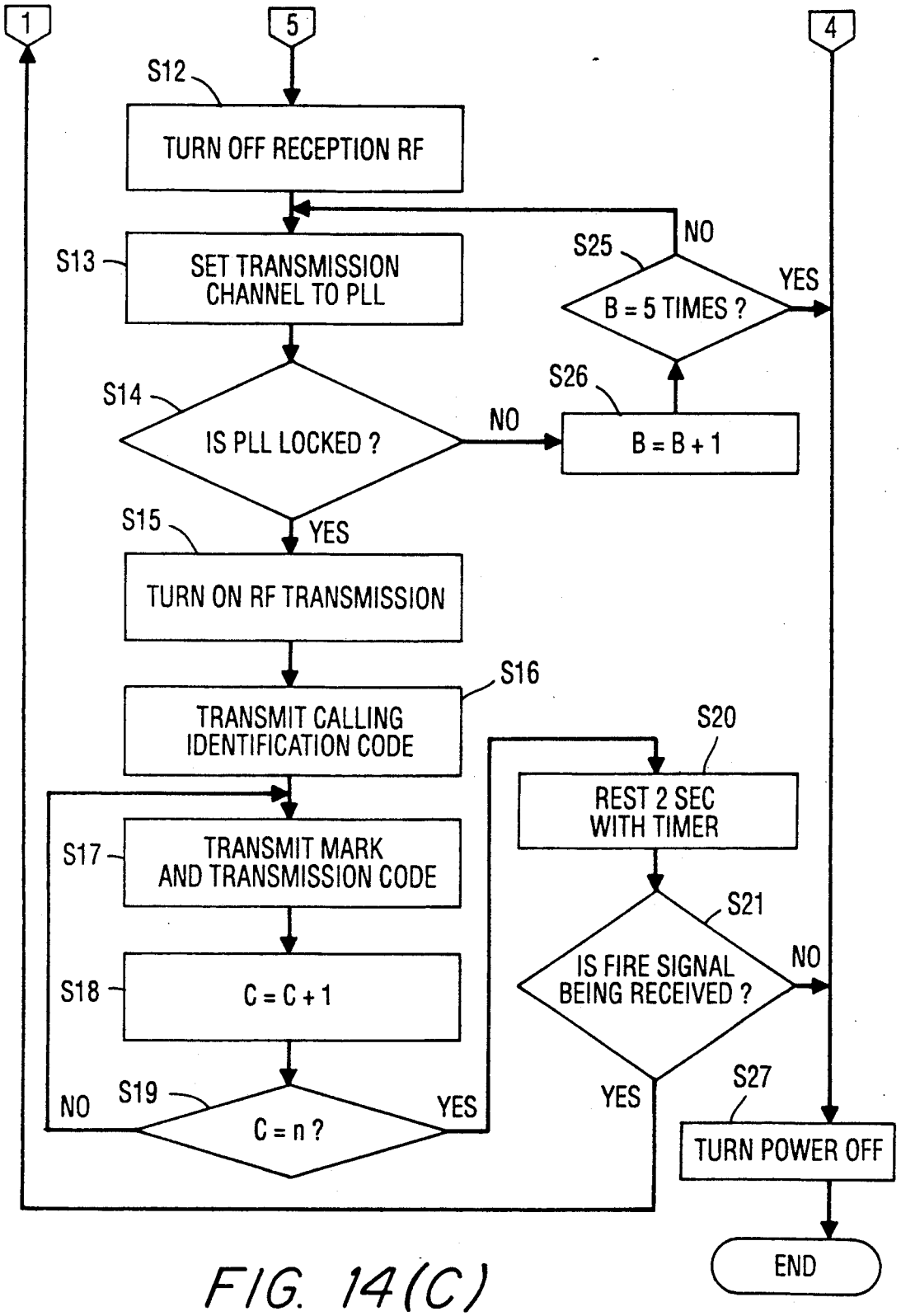

Assuming that the fire detector 10 has emitted a detection signal, the start circuit 30, which has received a reception output from the fire reception circuit 28, turns on the power control circuit 32, and causes the CPU 24 to be supplied with power from the battery power source 25, thereby power-on-starting the CPU 24 to execute the operational flow shown in FIGS. 14A, 14B, 14C.

Referring to FIGS. 14A, 14B, 14C, initialization is first effected in S1, and, in S2, a calling identification code, an expansion group address (of a higher order), an individual and a group address (of a lower order) from the address setting circuit 16, and delay times determined at random for the respective terminal devices, are read from the non-volatile memory 35, and are set. Subsequently, in S3, the dividing ratio data for obtaining the local oscillation frequency of the reception channel corresponding to the transmission channel is set in the PLL circuit 42. In this embodiment, the first transmission channel when power-on-start is effected is CH1, so that the dividing ratio data on the local oscillation frequency for receiving channel CH1 is set in the PLL circuit 42.

Next, the procedure moves on to S4, where a judgment is made as to whether the PLL circuit 42 has been locked in consequence of the setting of the dividing ratio data or not. If the PLL circuit 42 can be locked in the normal fashion, the procedure moves on to S5, where the power supply to the reception circuit section side is turned on, thereby setting it in the operating state.

If, in S4, the locking cannot be effected due to some abnormality in the PLL circuit 42, the procedure moves on to S24, where the counter A is incremented, and, in S23, a judgment is made as to whether the the counter A has attained the number of times of five or not. Afterwards, the procedure moves on to S22, where the dividing ratio data for the next channel, channel CH2, is set in the PLL circuit 42, making a judgment, again in S4, as to whether the locking of the PLL circuit has been effected or not. When the PLL circuit 42 cannot be locked, the operation of switching and setting the dividing ratio data for the next channel is repeated five times. If the locking cannot be effected even if the switching of the dividing ratio data has been repeated five times, the procedure moves from S23 to S27, where the power supply to the CPU 24 is stopped.

When the PLL circuit 42 is locked in the normal manner in S4 and the power supply to the reception circuit section side is turned on in S5, a judgment is made in S6 as to whether the power supply to the reception circuit side has been turned on or not, i.e., whether it is the first carrier sensing after the power-on-start or not. If it is the first carrier sensing, the procedure moves on to S7, where a waiting period of 300 ms is provided, during which the operation of the reception circuit section is stabilized.

Subsequently, the procedure moves on to S8, where it is checked whether a carrier has been detected or not. If no carrier has been detected, the lapse of the delay time is checked in S11, and the processes of S8 and S11 are repeated until the delay time expires. If a carrier has been detected in S8, the procedure moves on to S9, where it is checked whether the carrier detection is of a duration of a predetermined length or not. If the carrier sensing has been continued over a predetermined time, the procedure moves on to S10, where the dividing ratio data for the next reception channel is set in the PLL circuit 42. Then, the procedure returns to S4, repeating the same processes until a free channel is obtained.

When the delay time expires with no carrier having been detected, the procedure moves on to S12, where the power supply to the reception circuit is turned off. Next, in S13, the dividing ratio data for obtaining the carrier frequency of the selected transmission channel (free channel) is set in the PLL circuit 42.

Next, in S14, a judgment is made as to whether the PLL circuit 42 can be locked or not. If it can be locked in the normal manner, the procedure moves on to S15. If the PLL circuit has failed to be locked in the normal fashion, the procedure moves on to S26, where the counter B is incremented, and after making a judgment in S25 as to whether the counter B has reached the number of times of five or not, the procedure returns to S13, where the dividing ratio data for obtaining the carrier frequency of the same transmission channel is set again in the PLL circuit 42. When the PLL circuit 42 cannot be locked even if the setting of the same dividing ratio data has been repeated five times, the procedure moves from S25 to S27, where the power supply to the CPU 24 is turned off, thereby ending the transmitting operation.

When the PLL circuit 42 is locked in the normal manner in S14, the power supply to the transmission circuit section side is turned on in S15, thereby setting it in the operating state, and, in S16, a calling identification code is first transmitted as shown in FIG. 3. Next, in S17, marks and data are sent, and, in S18, the counter C for indicating the number of times the mark and data are transmitted is incremented. Subsequently, in S19, a judgment is made as to whether the counter C for counting the number of transmissions has attained a predetermined number n, which may, for example, be 75, and the processes of S17 ad S18 are repeated until the counter C attains this number 75. When the transmitting operation of a duration of eight minutes has been terminated through the processes of S17 and S18, the procedure moves on to S20, where a two seconds' rest is provided by means of a timer. Afterwards, the procedure moves on to S21, where a judgment is made as to whether the reception of a fire signal is going on or not. If the reception of a fire signal is going on, the procedure returns to S2, where the transmitting operation is performed again. If the fire signal has been stopped, the procedure moves on to S27, where the power supply to the CPU 24 is turned off, thereby ending the series of processes.

As is apparent from the above-described transmitting operation, if the PLL circuit 42 fails to be locked in consequence of the setting of the dividing ratio data when performing carrier sensing or transmitting operation, a re-try operation is performed to repeatedly reset the dividing ratio data on the next or the same channel. If the locking cannot be effected due to some temporary factor such as a noise, this re try operation allows the PLL circuit to be reliably set in the locked state, thus making it possible to perform transmission effectively.

While the above embodiment has been described as applied to the case where a fire detector is connected to each terminal device, it is also possible to connect some other type of abnormality detector, such as a gas leak detector or a trespasser detector, to each terminal device.

What is claimed is:

1. A radio alarm system comprising a plurality of terminal devices each of which is connected to a detector for detecting any abnormal state and each of which is adapted to transmit information in the form of a radio signal based on a detection signal from said detector, and a central unit adapted to receive and decode the radio signal from said terminal device and to give an alarm;

each of said terminal devices comprising:

channel searching means adapted to perform, when transmitting information, carrier sensing successively on a plurality of transmission channels previously allocated thereto, in a predetermined sequence and over a preset delay time, thereby selecting a free channel which is not being used by any other terminal device; and transmission control means adapted to transmit said information, along with the terminal device address, in a continuous manner to said central unit through the channel selected by said channel searching means, by repeating a cycle of a predetermined transmission period and a predetermined rest period.

2. A radio alarm system as claimed in claim 1, further comprising re-transmission control means adapted to operate such that, when re-transmitting said information at the end of a rest period provided by said transmission control means, it causes the carrier sensing on the transmission channels by said channel searching means to be performed starting from the channel used in the previous transmission.

3. A radio alarm system as claimed in claim 1, wherein each of said terminal devices has channel setting means adapted to perform channel setting automatically in accordance with preset terminal device addresses, in such a manner that the channel on which carrier sensing is performed first is different from terminal device to terminal device.

4. A radio alarm system as claimed in claim 3, wherein said channel setting means comprises:

a counter adapted to constantly repeat a clock counting operation;

an information table storing a series of values representing delay times in a pseudo-random arrangement; and delay time setting means adapted to set, when any abnormality is detected, the delay time to be used in said carrier sensing by reading an enumerated value from said counter and fetching the corresponding delay time from said series of values in said information table by using said enumerated value thus read as an index parameter.

5. A radio alarm system as claimed in claim 4, wherein said delay time setting means operates such that, for each of the transmissions from the second transmission onwards in a continuous transmission mode, it effects delay time setting by fetching from said information table the next delay time to the one previously fetched.

6. A radio alarm system comprising a plurality of terminal devices each of which is connected to a detector for detecting any abnormal state and each of which is adapted to transmit information in the form of a radio signal based on a detection signal from said detector, and a central unit adapted to receive and decode the radio signal from said terminal device and to give an alarm;

each of said terminal devices comprising:

channel searching means adapted to set the terminal device in a receiving state first when any abnormality is detected and to perform carrier sensing with a reception signal obtained through an oscillation generated by setting, in a PLL circuit, dividing ratio data on a local oscillation frequency, thereby selecting a free channel which is not being used by any other terminal device; and transmission control means adapted to generate an oscillation by setting, in said PLL circuit, dividing ratio data on the carrier frequency of the selected free channel so as to transmit an abnormality detection signal to said central unit;

said central unit successively performing carrier sensing on the same predetermined number of channels as are allocated to each of said terminal devices and fixing the carrier channel where any carrier is detected in a receiving state so as to receive the abnormality detection signal.

7. A radio alarm system as claimed in claim 6, further comprising a PLL control means, adapted to function in such a manner that, if the PLL circuit of said terminal device fails to be locked when dividing ratio data is set therein for the purpose of performing carrier sensing, it sets the dividing ratio data on the next channel, and that, if said PLL circuit fails to be locked when, in transmission, dividing ratio data is set therein for generating the carrier frequency of said selected channel, it repeats the setting of the same dividing ratio data a plurality of times.

* * * * *